US009988742B2

(12) United States Patent
Greenawalt

(10) Patent No.: US 9,988,742 B2
(45) Date of Patent: Jun. 5, 2018

(54) CENTRIFUGAL ELECTROSPINNING PROCESS

(71) Applicant: Donaldson Company, Inc., Minneapolis, MN (US)

(72) Inventor: Frank E. Greenawalt, Dixon, IL (US)

(73) Assignee: Donaldson Company, Inc., Minneapolis, MN (US)

( * ) Notice: Subject to any disclaimer, the term of this patent is extended or adjusted under 35 U.S.C. 154(b) by 304 days.

(21) Appl. No.: 14/783,372

(22) PCT Filed: Apr. 11, 2014

(86) PCT No.: PCT/US2014/033850
§ 371 (c)(1),
(2) Date: Oct. 8, 2015

(87) PCT Pub. No.: WO2014/169239
PCT Pub. Date: Oct. 16, 2014

(65) Prior Publication Data

US 2016/0047062 A1 Feb. 18, 2016

Related U.S. Application Data

(60) Provisional application No. 61/811,335, filed on Apr. 12, 2013.

(51) Int. Cl.
*D01D 7/00* (2006.01)
*D01D 5/00* (2006.01)
(Continued)

(52) U.S. Cl.
CPC ..... *D01D 5/0069* (2013.01); *D01D 5/0038* (2013.01); *D01D 5/18* (2013.01); *D04H 1/728* (2013.01)

(58) Field of Classification Search
CPC ..... B29C 41/24; D01D 5/003; D01D 5/0038; D01D 5/18; D01D 7/00
(Continued)

(56) References Cited

U.S. PATENT DOCUMENTS

2002/0059868 A1* 5/2002 Gogins ..... B01D 39/1623 95/280
2006/0012084 A1 1/2006 Armantrout et al.
(Continued)

FOREIGN PATENT DOCUMENTS

EP 1 999 304 B1 12/2008
WO WO 2009/079523 A2 6/2009
WO WO 2010/043002 A1 4/2010

OTHER PUBLICATIONS

International Preliminary Report on Patentability for PCT Application No. PCT/US2014/033850, dated Oct. 13, 2015; 6 pgs.
(Continued)

*Primary Examiner* — Leo B Tentoni
(74) *Attorney, Agent, or Firm* — Andrew F. Johnson

(57) ABSTRACT

The present disclosure provides a fiber-forming process that includes: providing a centrifugal electrospinning apparatus that includes: an emitter that includes a rotating element having a rotational speed of 10,000 rpm or less; and a collector; and providing a spinning solution including at least one polymer dissolved in at least one solvent; supplying the spinning solution to the emitter; and directing the spinning solution from the emitter toward the collector under conditions effective to form separate fibrous streams from the spinning solution, vaporize the solvent, and produce polymeric fibers on the collector.

18 Claims, 22 Drawing Sheets

(51) Int. Cl.
*D04H 1/728* (2012.01)
*D01D 5/18* (2006.01)

(58) Field of Classification Search
USPC ..... 264/10, 211.1, 211.12, 310, 311, 464, 264/465, 466, 484, 555
See application file for complete search history.

(56) References Cited

U.S. PATENT DOCUMENTS

| | | | | |
|---|---|---|---|---|
| 2009/0162468 | A1 | 6/2009 | Barinov et al. | |
| 2010/0032872 | A1 | 2/2010 | Marshall et al. | |
| 2010/0129628 | A1* | 5/2010 | Young | D01D 5/18 264/211.1 X |
| 2011/0156319 | A1 | 6/2011 | Kurokawa et al. | |
| 2012/0171355 | A1 | 7/2012 | Larsen et al. | |

OTHER PUBLICATIONS

Myers et al., *Response Surface Methodology: Process and Product Optimization Using Designed Experiments*, 3rd Edition, John Wiley & Sons, Inc., Hoboken, NJ, 2009, cover page, publisher's page, table of contents, 8 pgs.

Chen, "Integrated Robust Design Using Response Surface Methodology and Constrained Optimization," Thesis, University of Waterloo, 2008, 142 pgs.

Kleijnen, "Response Surface Methodology for Constrained Simulation Optimization: an Overview," Simulation Modelling Practice and Theory, 2009;16(1):50-64 (Preprint submitted to Elsevier Science, Sep. 20, 2007, 24 pgs).

PCT Patent Application No. PCT/US2014/033850, filed Apr. 11, 2014; International Search Report and Written Opinion dated Aug. 22, 2014; 8 pages.

Petrik, "Industrial Production Technology for Nanofibers," in *Nanofiber Production Properties and Functional Applications*. Lin (Ed.) Oct. 2011, pp. 1 & 4-17. (retrieved from www.intechopen.com on Oct. 7, 2015).

Raissi et al., "Statistical Process Optimization Through Multi-Response Surface Methodology," World Academy of Science, Engineering and Technology, 2009;51:267-271.

* cited by examiner

CENTRIFUGAL ELECTROSPINNING PROCESS

CROSS-REFERENCE TO RELATED APPLICATION

The present application is a U.S. National Stage Application of International Application No. PCT/US2014/033850, titled CENTRIFUGAL ELECTROSPINNING PROCESS, filed on 2014 Apr. 11, which claims the benefit of U.S. Provisional Patent Application No. 61/811,335, filed on 2013 Apr. 12, each of which is incorporated herein by reference in its entirety.

BACKGROUND OF THE DISCLOSURE

The centrifugal electrospinning process has been a recent targeted approach for generating high output of nanofibers. Centrifugal electrospinning can produce fine fibers faster than conventional electrospinning. Centrifugal electrospinning may be described as a combination of centrifugal force spinning and electrospinning. Centrifugal electrospinning process may create a number of new design challenges that makes it even more complex than traditional electrospinning.

SUMMARY

There are continued efforts in centrifugal electrospinning development to maximize nanofiber output, increase media efficiency, minimize nanofiber size, and provide a repeatable process in a production environment. A method of optimizing a centrifugal electrospinning process is provided herein. Preferably, such methods may be capable of producing high efficiency media with nanofiber diameters less than one micron.

In one embodiment, the present disclosure provides a fiber-forming process that includes: providing a centrifugal electrospinning apparatus including: an emitter that includes a rotating element; a collector; and a voltage potential between the emitter and the collector; providing a spinning solution including at least one polymer dissolved in at least one solvent; supplying the spinning solution to the emitter; and directing the spinning solution from the emitter toward the collector under conditions effective to form separate fibrous streams from the spinning solution, vaporize the solvent, and produce polymeric fibers on the collector.

As described herein, "fibers" have an aspect ratio (i.e., length to lateral dimension) of greater than 3:1, and preferably greater than 5:1. For example, fiberglass typically has an aspect ratio of greater than 100:1. In this context, the "lateral dimension" is the width (in 2 dimensions) or diameter (in 3 dimensions) of a fiber. The term "diameter" refers either to the diameter of a circular cross-section of a fiber, or to a largest cross-sectional dimension of a non-circular cross-section of a fiber. Fiber lengths may be between an order of the fiber diameter to many of orders of or a magnitude larger than the fiber diameter, depending on the desired result.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements. By "consisting of" is meant including, and limited to, whatever follows the phrase "consisting of" Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they materially affect the activity or action of the listed elements.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one."

The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

Also herein, all numbers are assumed to be modified by the term "about" and preferably by the term "exactly." As used herein in connection with a measured quantity, the term "about" refers to that variation in the measured quantity as would be expected by the skilled artisan making the measurement and exercising a level of care commensurate with the objective of the measurement and the precision of the measuring equipment used.

Also herein, the recitations of numerical ranges by endpoints include all numbers subsumed within that range as well as the endpoints (e.g., 1 to 5 includes 1, 1.5, 2, 2.75, 3, 3.80, 4, 5, etc.). Herein, "up to" a number (e.g., up to 50) includes the number (e.g., 50).

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DRAWINGS

The disclosure may be more completely understood in connection with the following drawings.

Figure 3A:
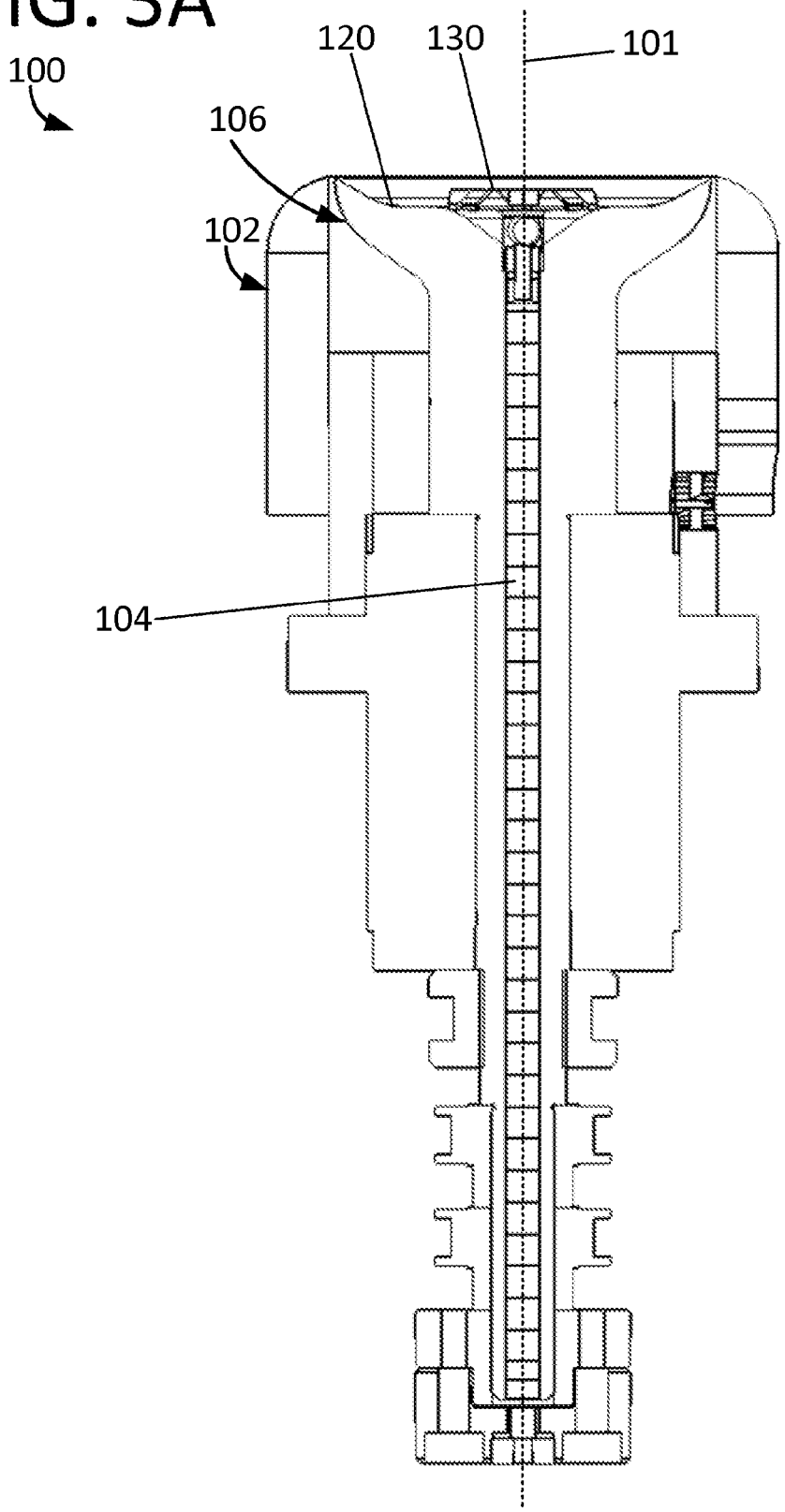
FIG. 3A is a schematic of an exemplary centrifugal electrospinning apparatus that uses a rotating free-surface edge emitter.
Figure 3B:
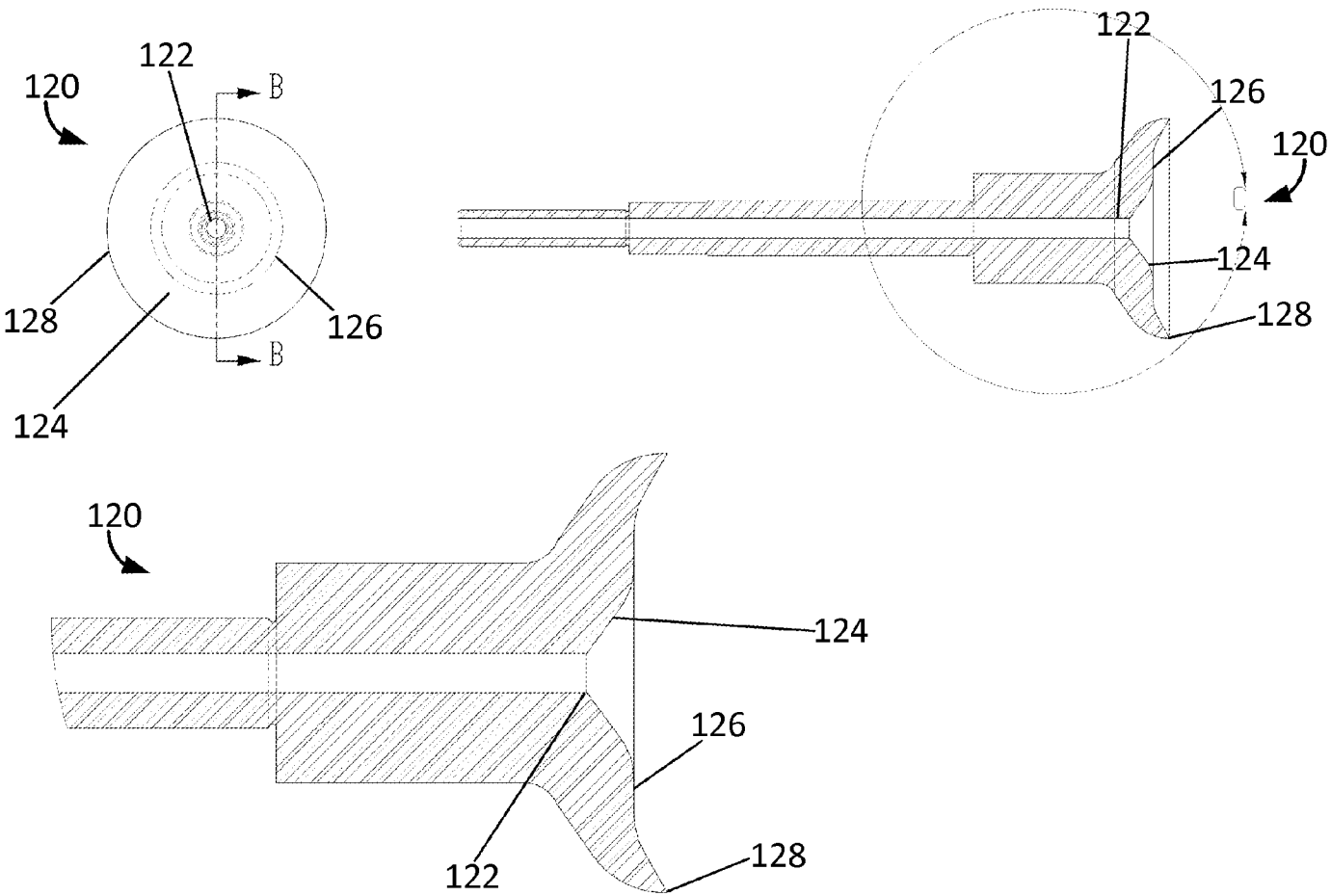

FIG. 3B includes cross-sectional and plan views of an exemplary discharge portion of the apparatus of FIG. 3A.

Figure 3C:
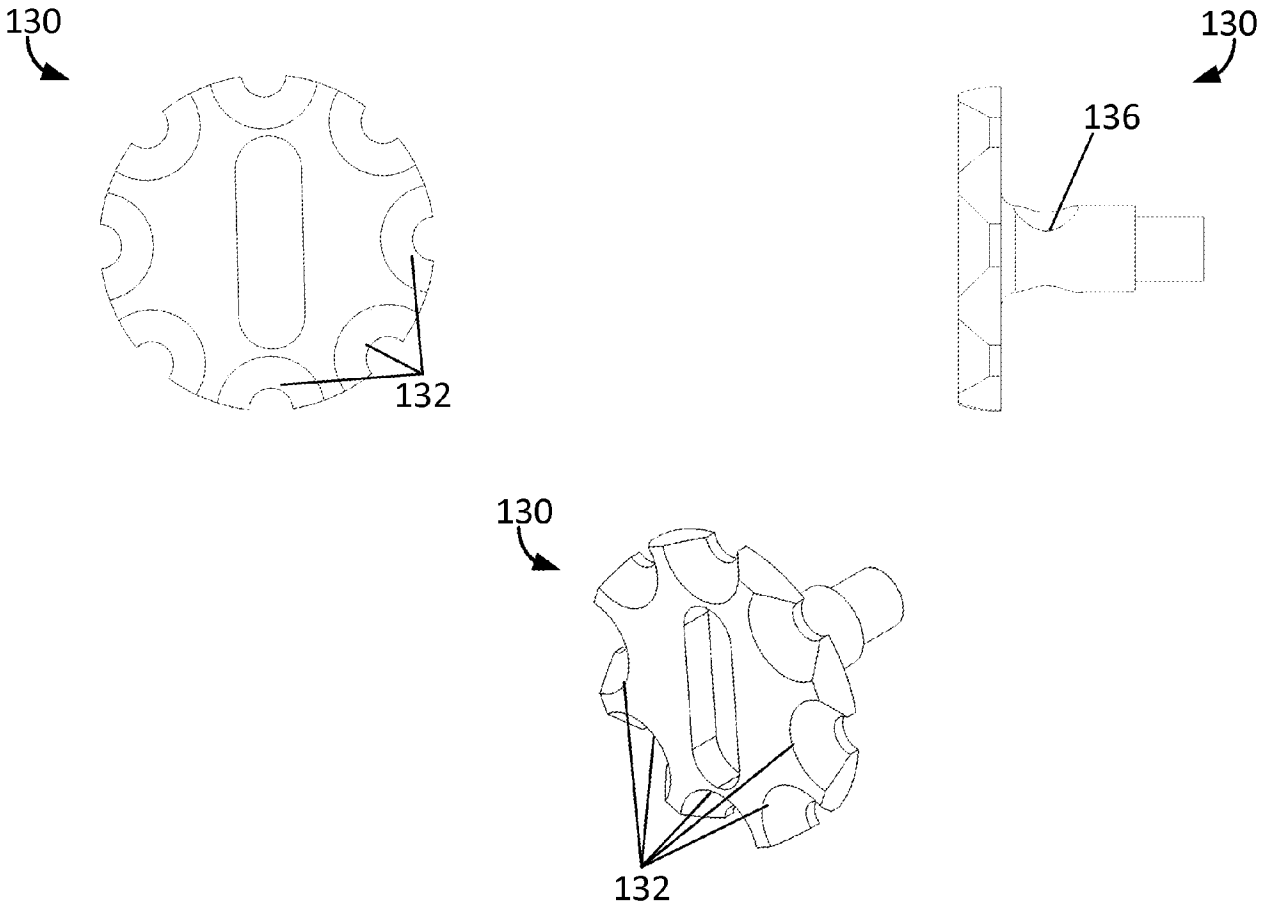

FIG. 3C includes end, side, and perspective views of an exemplary diffuser portion of the apparatus of FIG. 3A.

Figure 4:
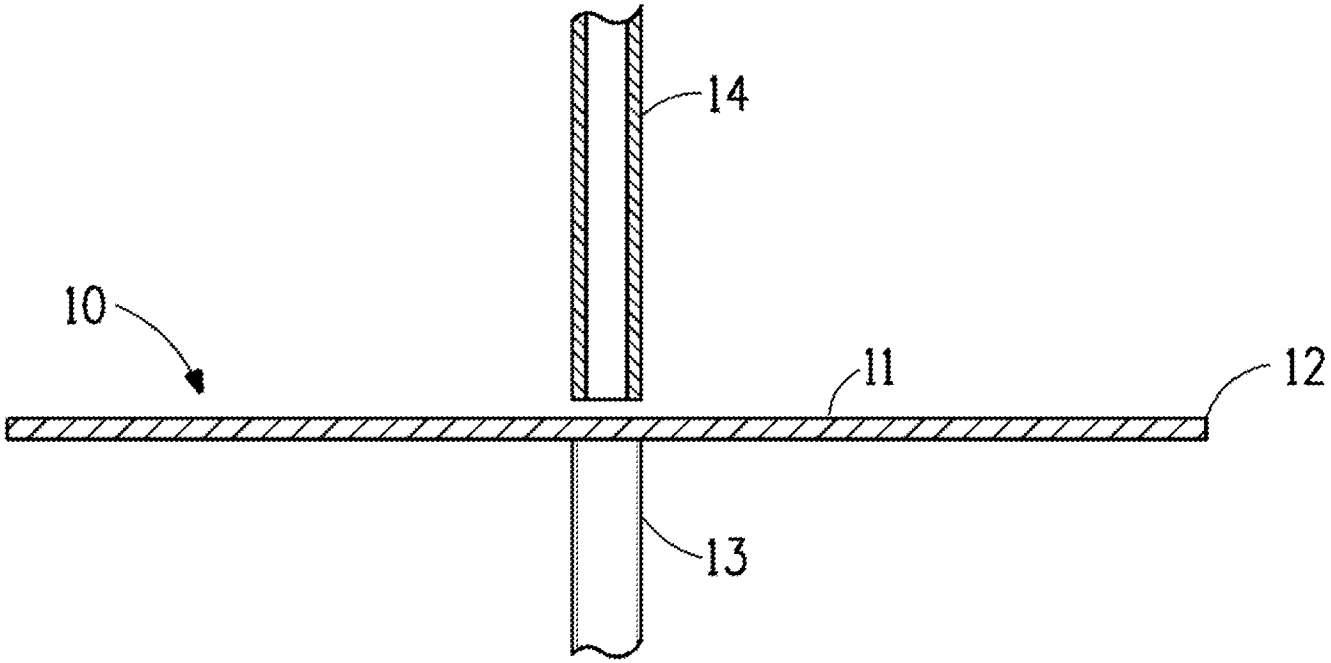

FIG. 4 is a schematic of an exemplary centrifugal electrospinning apparatus that uses a rotary disc.

Figure 5:
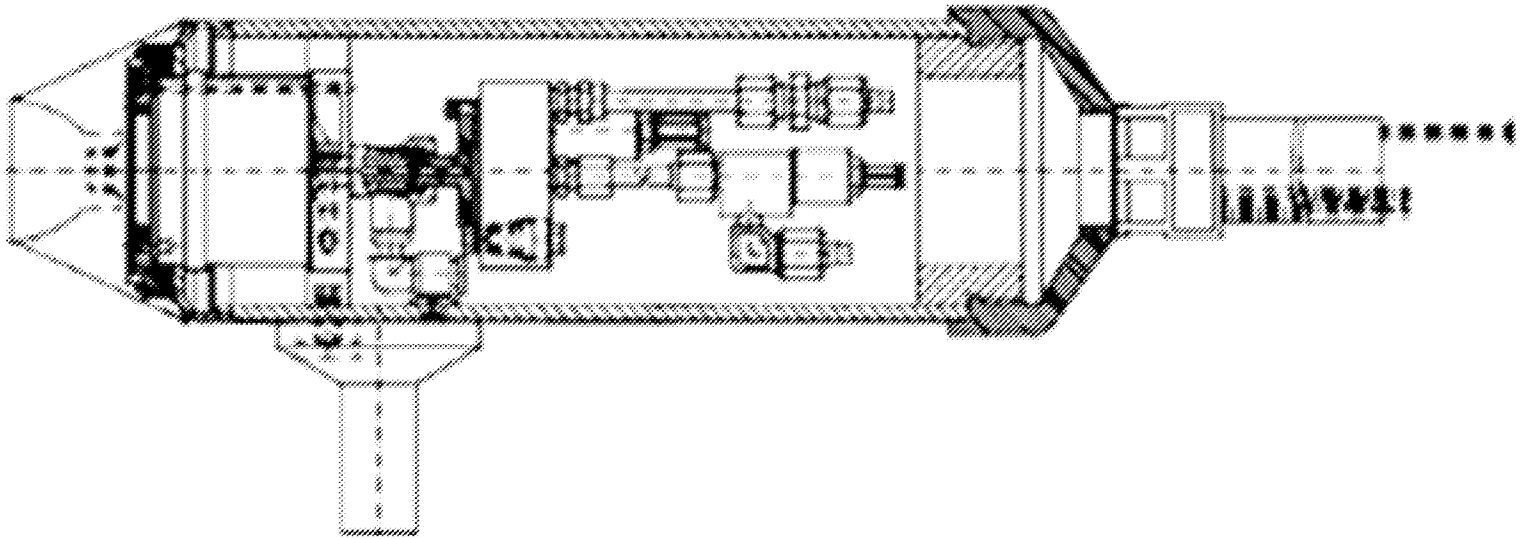

FIG. 5 is a schematic of an exemplary centrifugal electrospinning apparatus that uses a spray atomizer.

Figure 6:
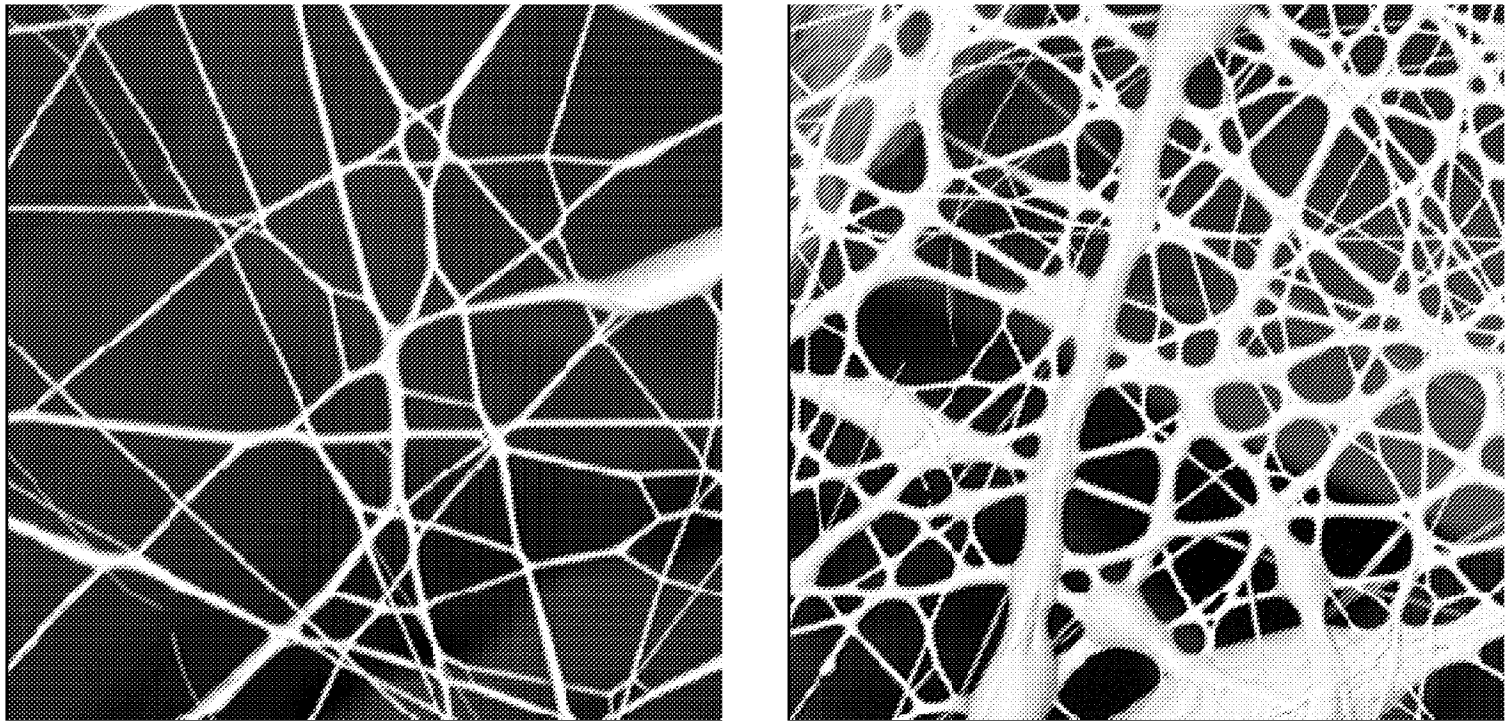

FIG. 6 shows SEM images of filtration media with nanofiber of differing fiber sizes (and resulting efficiency) applied by a centrifugal electrospinning process.

Figure 7:
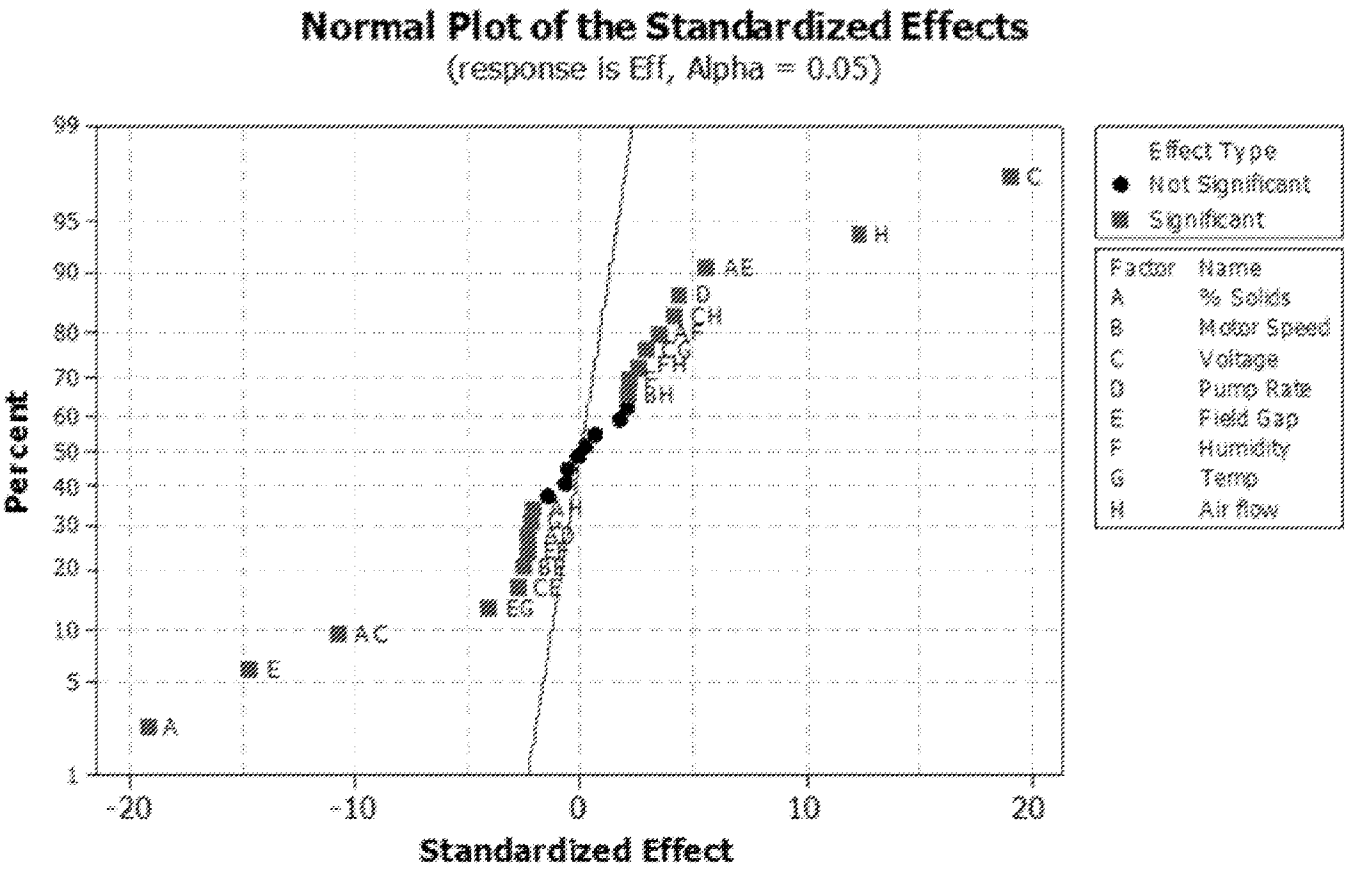

FIG. 7 shows the Normal Plot of an RSM Main Effects Model applied to a centrifugal electrospinning process as described herein.

Figure 8:
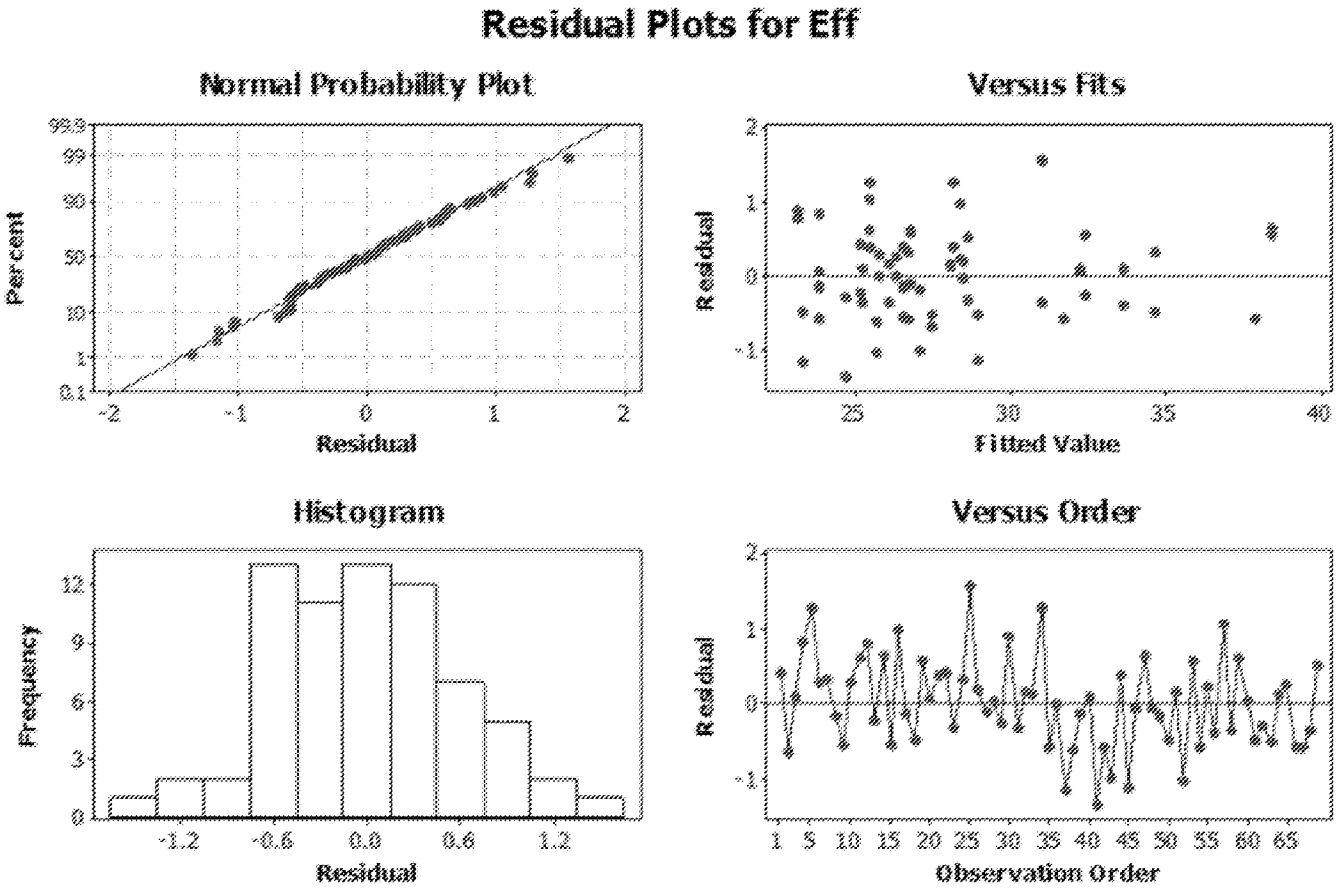

FIG. 8 shows the Residual Plot—Efficiency Response.

Figure 9:
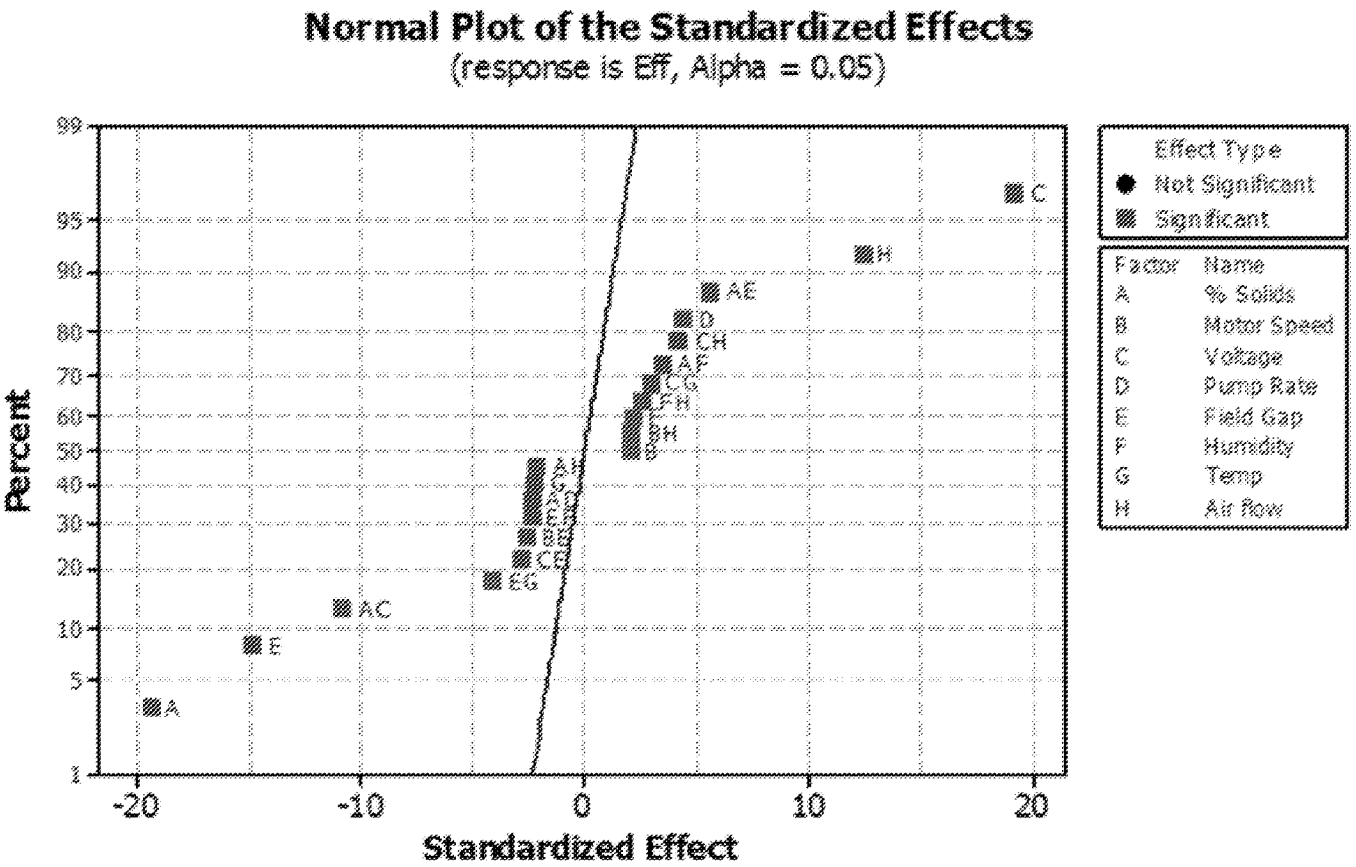

FIG. 9 shows the Normal Plot of and RSM Reduced Effects Model for Efficiency.

Figure 10:
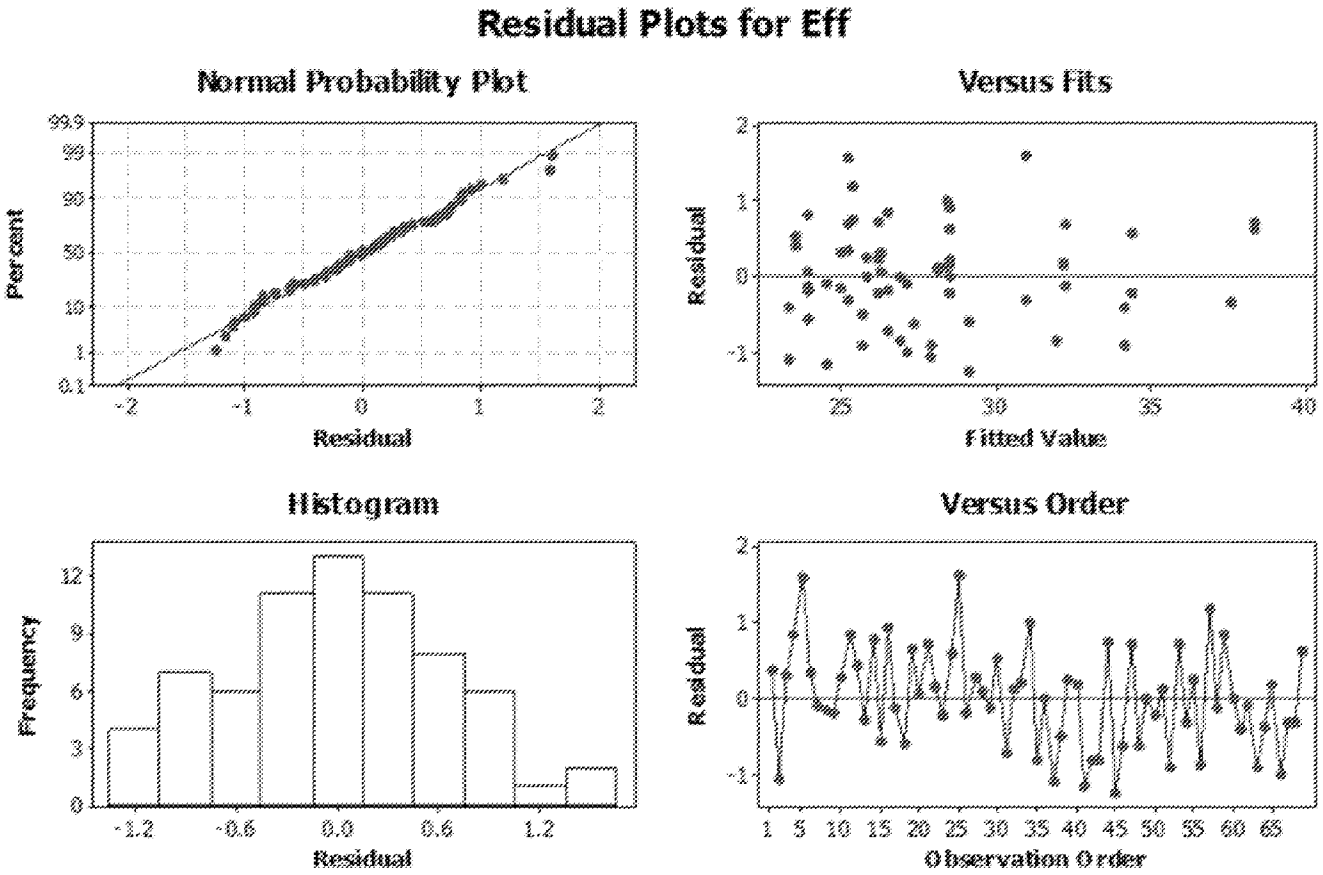

FIG. 10 shows the Residual Plot—Efficiency Response.

Figure 11:
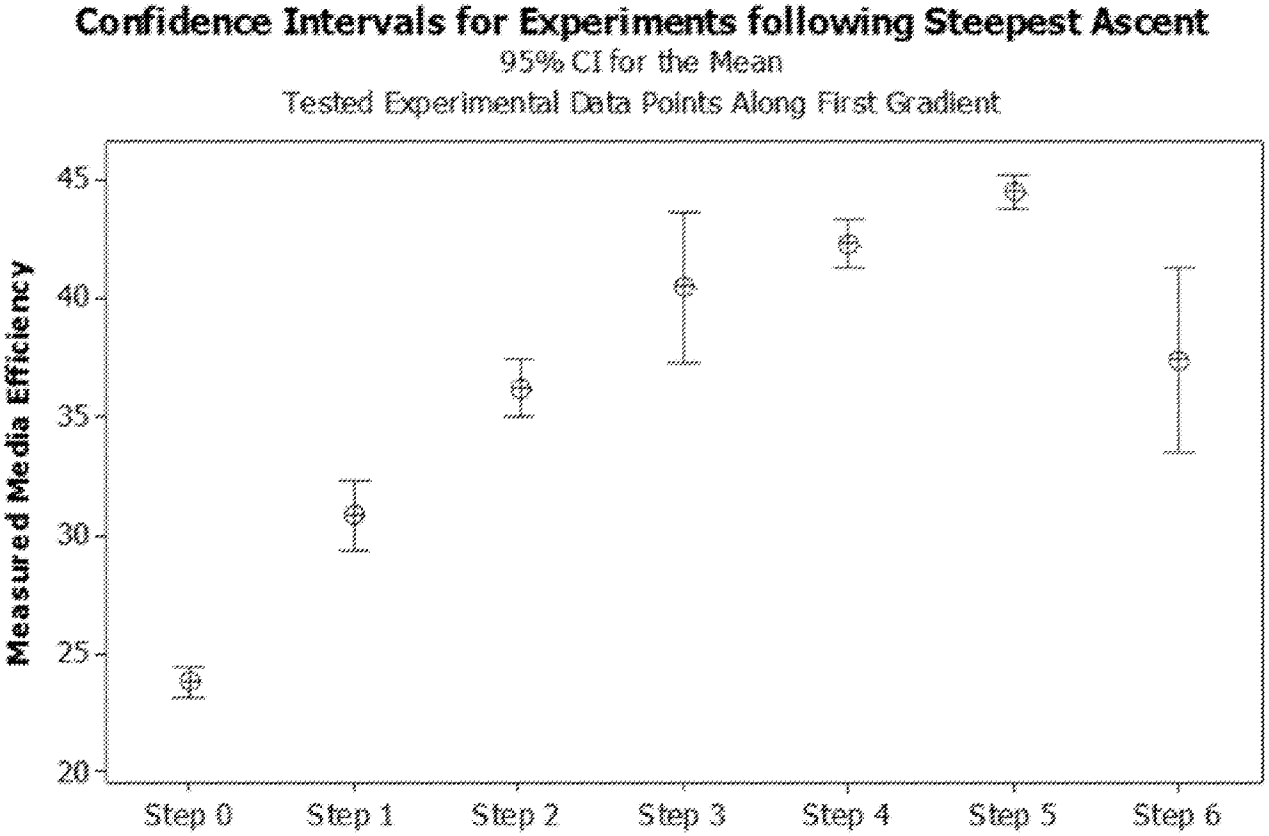

FIG. 11 shows a graph of the Initial Steepest Ascent CI for Media Efficiency.

Figure 12:
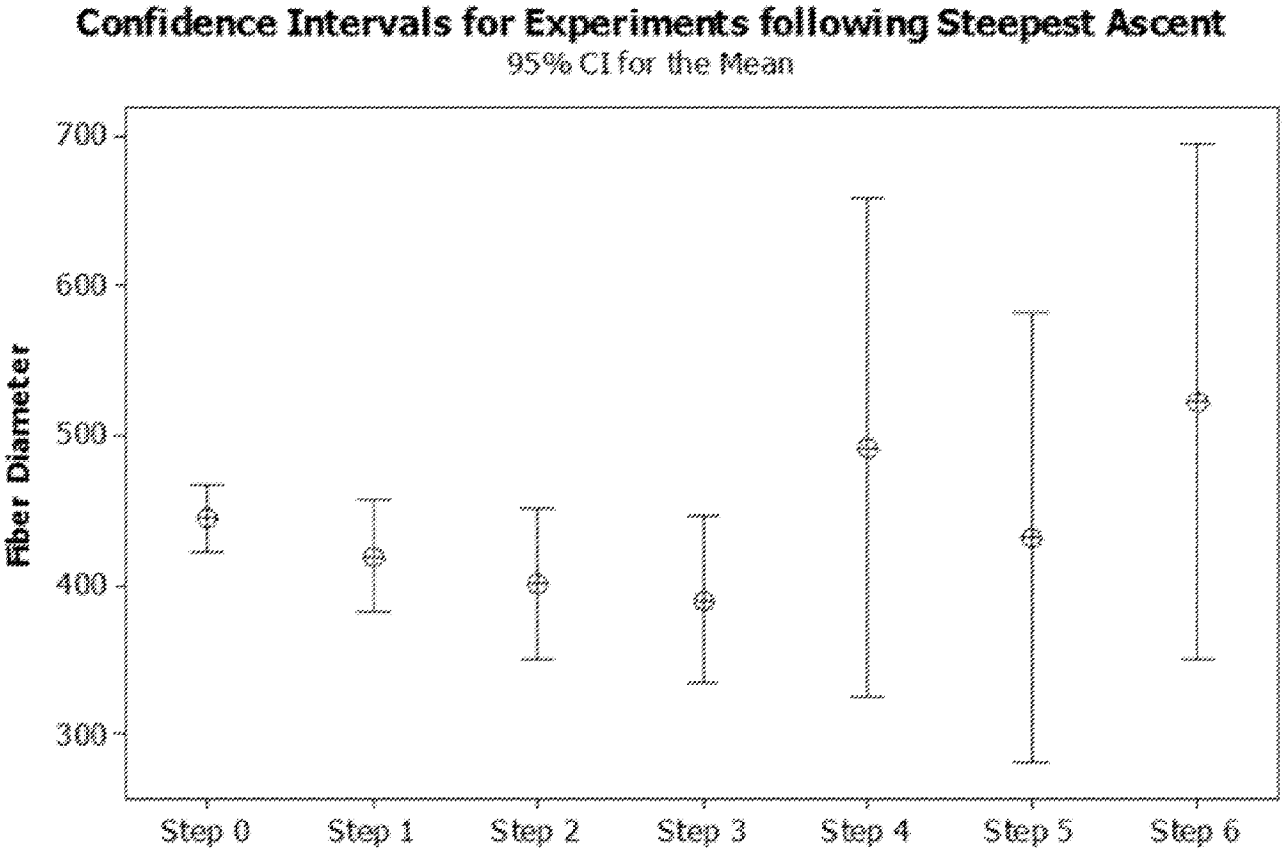

FIG. 12 shows a graph of the Initial Steepest Ascent CI for Smallest Fiber Diameter.

Figure 13:
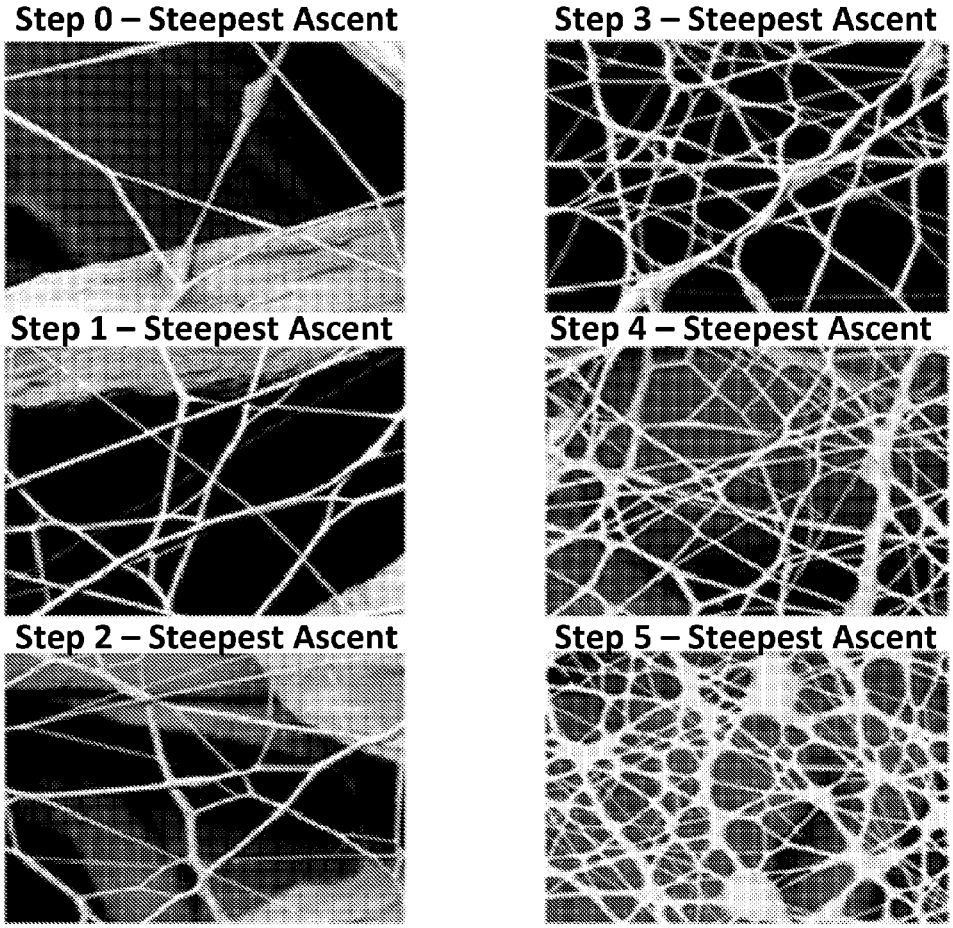

FIG. 13 shows SEM Images of Initial Steepest Ascent Steps (9300×).

Figure 14:
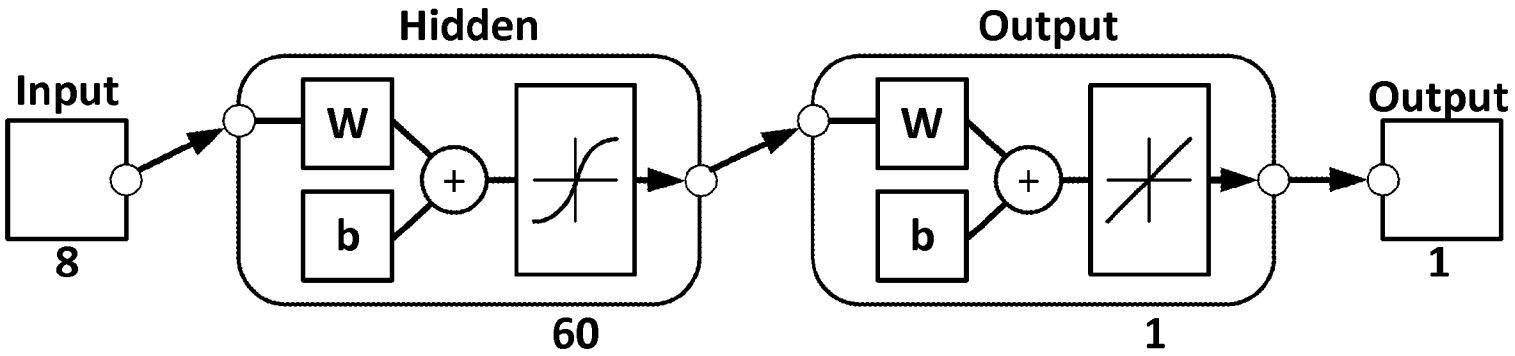

FIG. 14 is an illustration of the Feedforward Backpropagation Network.

Figure 15:
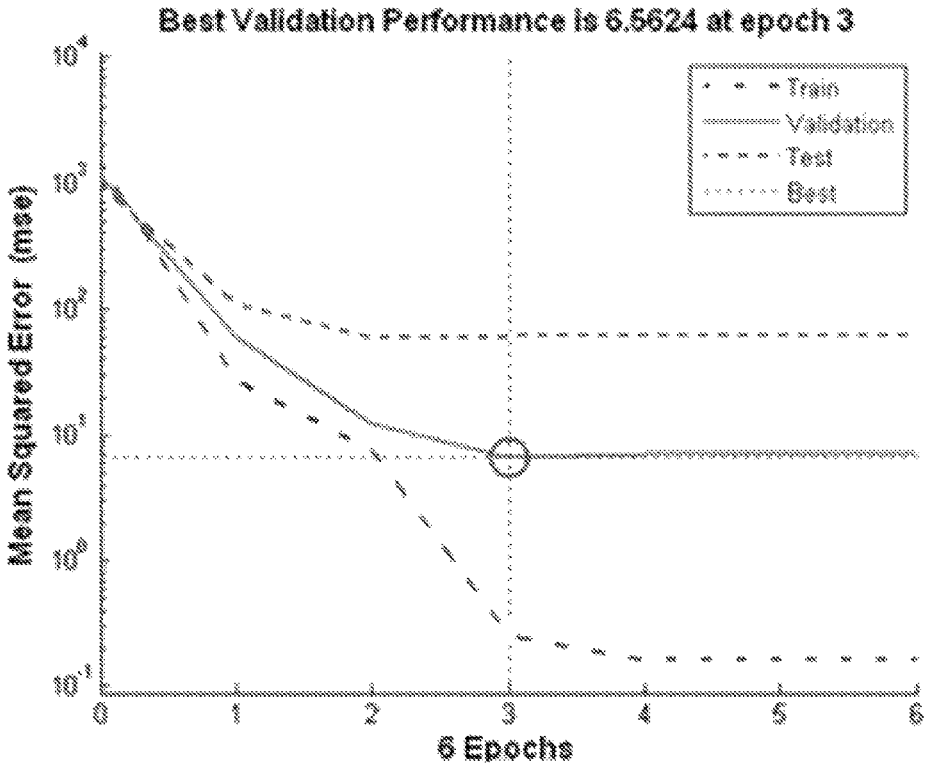

FIG. 15 shows the Feedforward Backpropagation Performance Plot.

Figure 16:
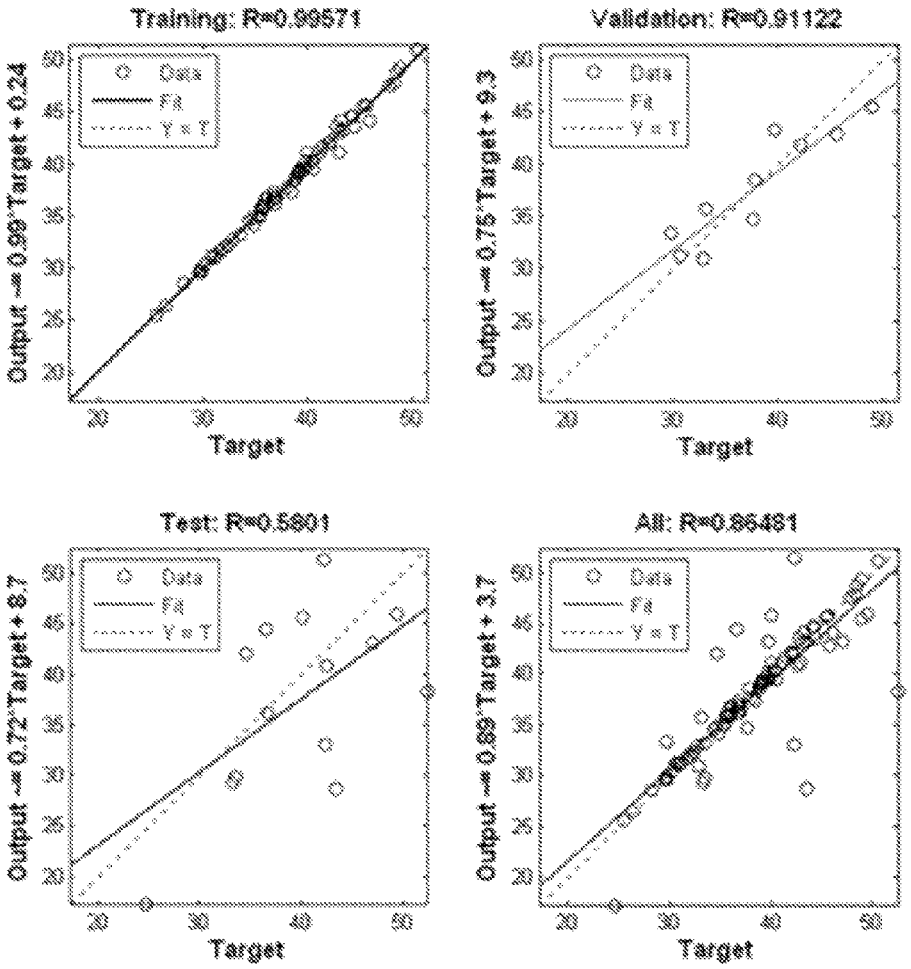

FIG. 16 shows the Feedforward Backpropagation Residual Plots.

Figure 17:
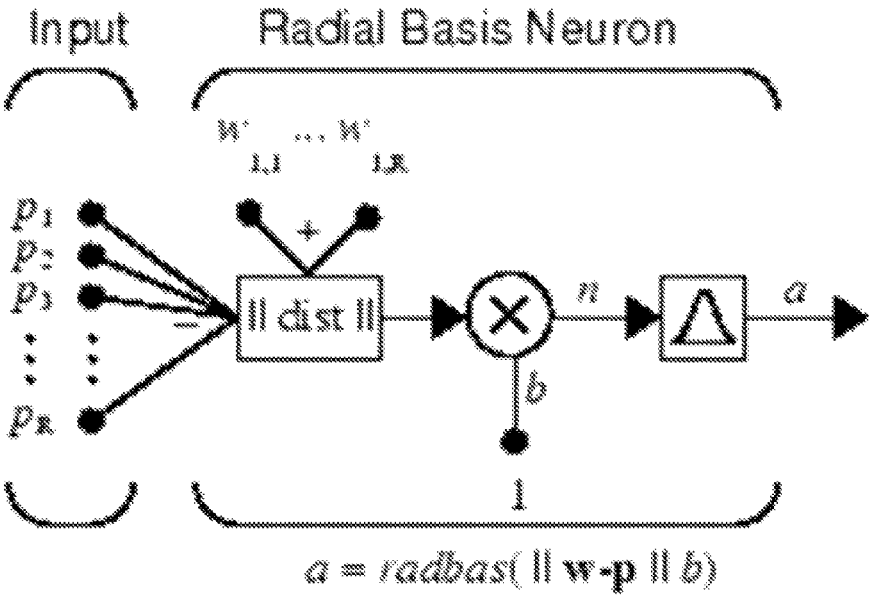

FIG. 17 is an illustration of the Radial Basis Network Diagram.

Figure 18:
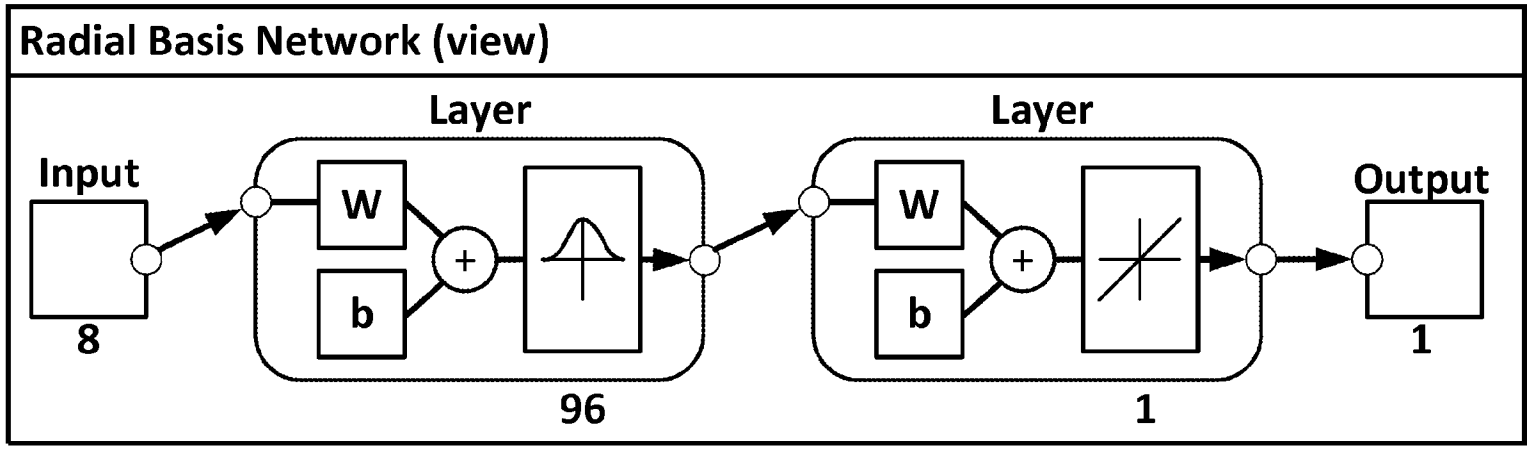

FIG. 18 shows the Radial Basis neural network design.

Figure 19:
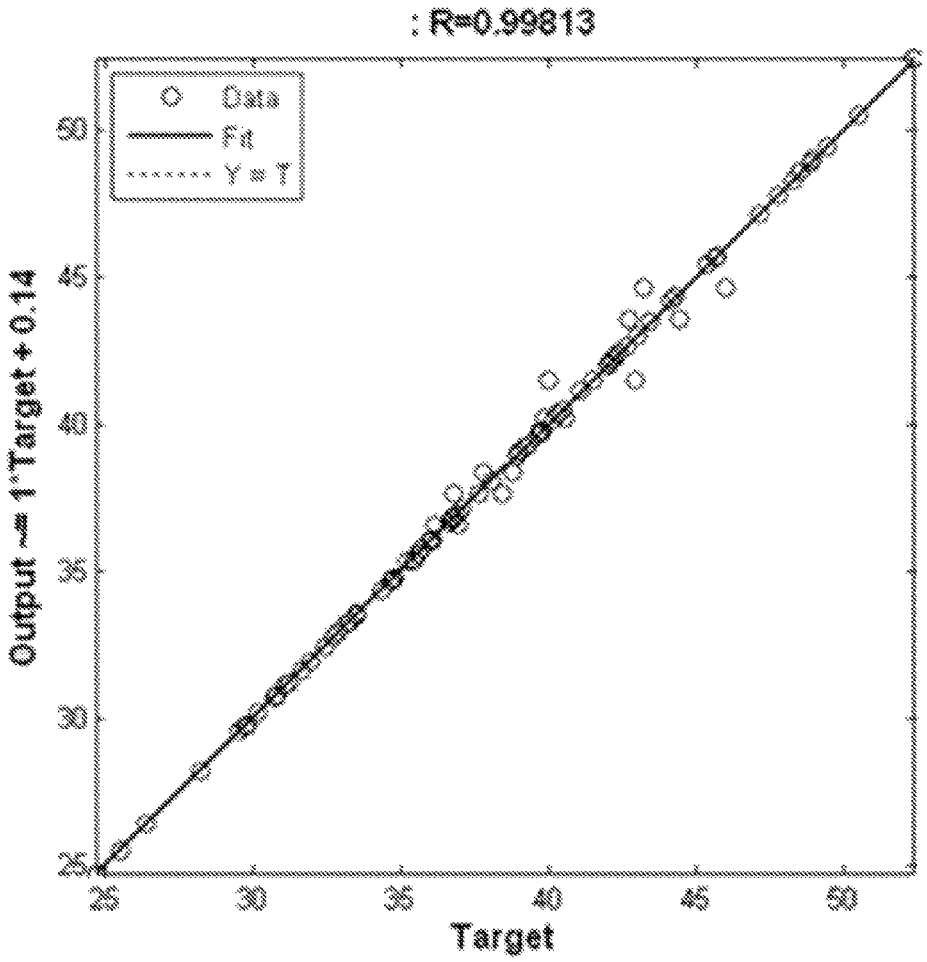

FIG. 19 shows the residual plot results for the trained Radial Basis network.

Figure 20:
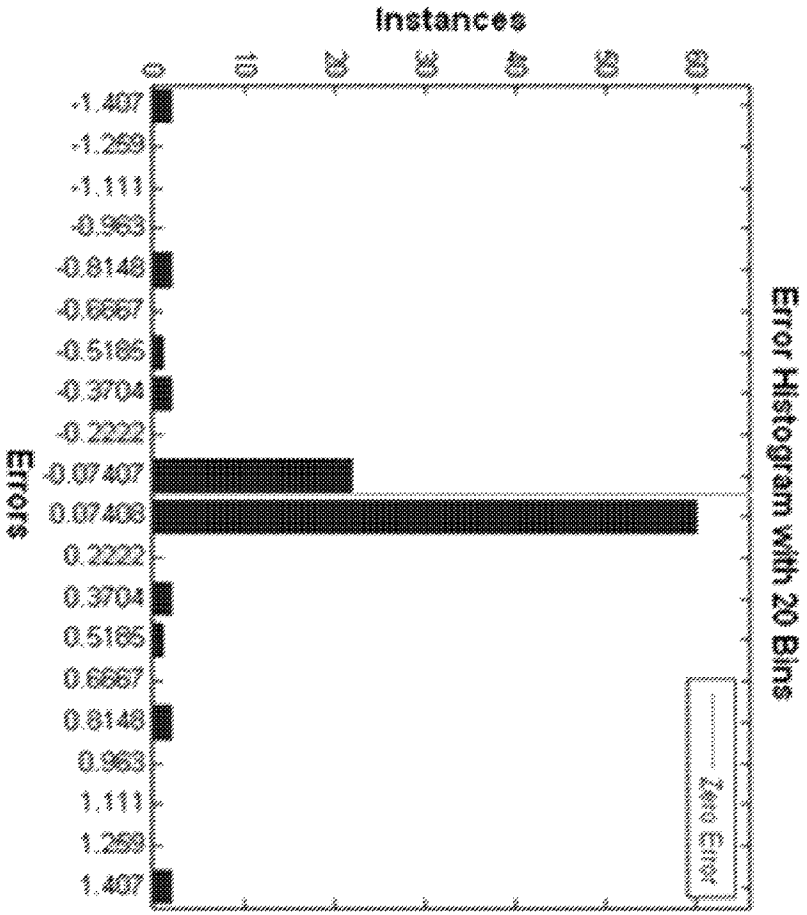

FIG. 20 shows the Error Histogram Plot for the neural network.

DETAILED DESCRIPTION OF ILLUSTRATIVE EMBODIMENTS

The present disclosure is related to centrifugal electrospinning of a polymer solution to form fibers. Centrifugal electrospinning uses a combination of centrifugal forces and electrostatic forces. The centrifugal forces apply shear forces on the polymer solution to generate nanofibers and/or increase capacity of the process. The electrostatic force may be used to generate the nanofibers and/or control the flight of the fibers to the collector. Both centrifugal forces and electrostatic forces impact the morphology of the final fiber structure.

The present disclosure provides improved centrifugal electrospinning processes. Such processes are able to generate high nanofiber output. Furthermore, the processes of the present disclosure are capable of producing high efficiency media with fiber diameters less than two microns (2000 nm), or less than one micron (1000 nm), or even less than 800 nanometers (nm), or less than 500 nm. Typically, fiber diameters less than 500 nm are called nanofibers. In certain embodiments, the fiber diameters are at least 40 nm, and in certain embodiments at least 100 nm.

In a fiber-forming process of the present disclosure, a spinning solution is used that includes at least one polymer dissolved in at least one solvent. The polymers are any of a wide variety of polymers capable of forming fibers. A centrifugal electrospinning apparatus is used that provides conditions effective to spin the solution, form separate fibrous streams from the spinning solution, vaporize the solvent, and produce polymeric fibers.

Suitable fiber-forming polymers are those that are able to dissolve in a solvent that can be vaporized during a fiber-forming process. Exemplary polymers include polyalkylene oxides, poly(meth)acrylates, polystyrene based polymers and copolymers, vinyl polymers and copolymers, fluoropolymers, polyesters and copolyesters, polyurethanes, polyalkylenes, polyamides, polyaramids, thermoplastic polymers, liquid crystal polymers, engineering polymers, biodegradable polymers, bio-based polymers, natural polymers, and protein polymers. Various combinations of such polymers can be used if desired.

Suitable solvents are those that are able to solubilize the desired polymers and vaporize during the fiber-forming process. Exemplary solvents may include one or more of alcohols (e.g., ethanol (EtOH), acids (e.g., formic acid), hydrocarbons (toluene, xylene, etc.) or others, or a mixture of these solvents.

Centrifugal Electrospinning Apparatus

Figure 1:
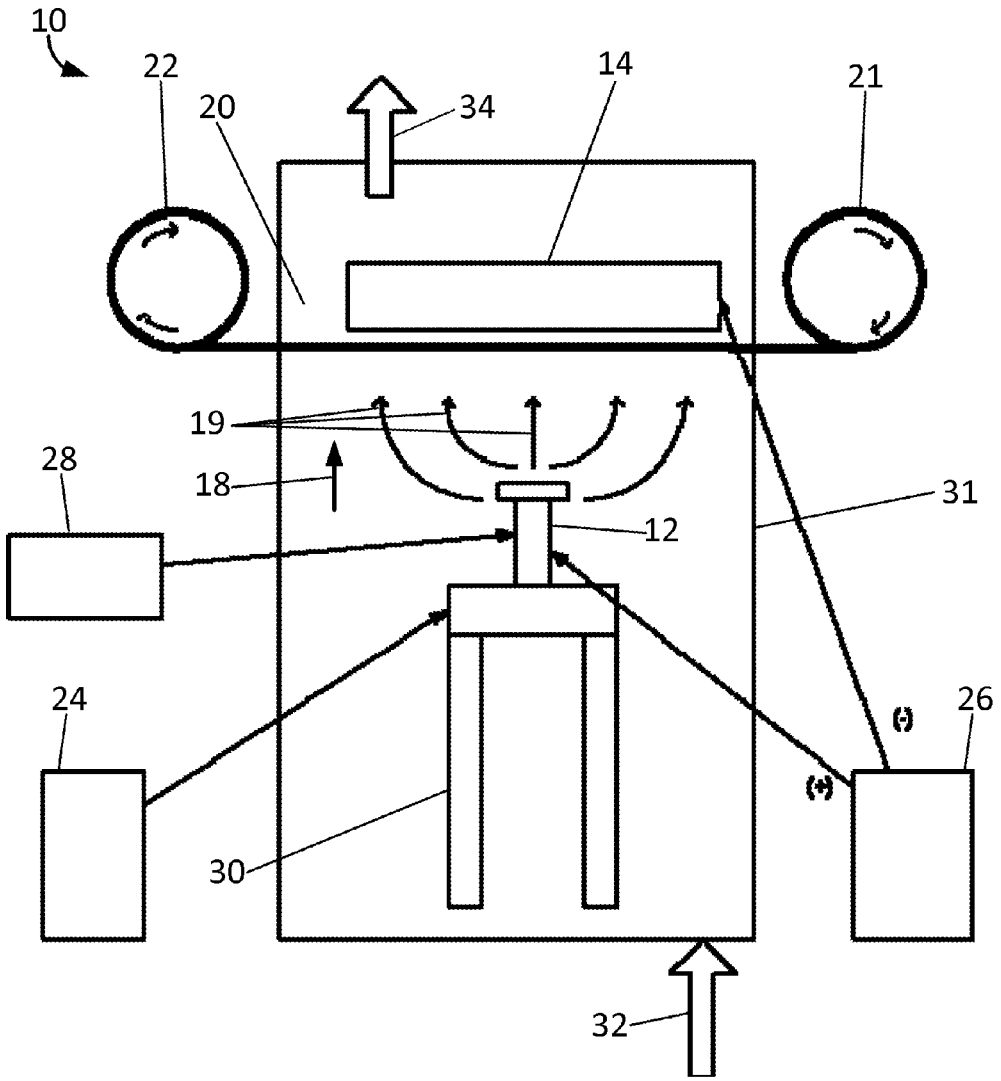
FIG. 1 is a schematic of an exemplary centrifugal electrospinning apparatus useful for carrying out a process of the present disclosure.

Referring to FIG. 1, an exemplary centrifugal electrospinning apparatus for carrying out a process of the disclosure is shown. The centrifugal electrospinning apparatus 10 typically includes an emitter 12 and a collector 14, wherein the emitter 12 includes a rotating element. The distance between the emitter 12 and the collector 14 can be varied as discussed below. In this exemplary design, the collector 14 is located above the emitter 12 in a vertical position, such that the spinning solution 16 is directed from the emitter 12 toward the collector 14, in an upward direction 18 (i.e., a direction against gravity). In an alternative embodiment, the collector can be located below the emitter in a vertical position, such that the spinning solution can be directed from the emitter toward the collector in a downward direction (i.e., in the direction of gravity). Other directions, e.g., a horizontal direction, can also be used.

A substrate 20, which is optional, is shown disposed on the collector 14 with a feed roll 21 and a take-up roll 22. A pump 24 (e.g., a positive displacement pump with a variable speed motor) is used to supply the spinning solution to the emitter 12. Additional pumps can be used if desired to increase the spinning solution flow rate to the emitter.

A power supply 26 is used to apply an electrical field to the apparatus, i.e., to create a voltage potential between the emitter 12 and the collector 14.

Either the emitter or the collector can be charged with the other component substantially grounded, or they can both be charged, so long as a voltage potential exists between them. In addition, an optional electrode (not shown) can be positioned between the emitter and the collector wherein the electrode is charged so that a voltage potential is created between the electrode and the emitter and/or the collector.

The emitter 12 can turn clockwise or counter-clockwise to control fiber uniformity. The emitter 12 can be positioned either parallel or angled to the collector 14.

If desired, a shaping fluid can be used to direct the spinning solution away from the emitter. The shaping fluid can be a gas. Various gases at various temperatures can be used to decrease or to increase the rate of solvent vaporization to affect the type of fiber that is produced. Thus, the shaping fluid can be heated or cooled in order to optimize the rate of solvent vaporization. A suitable gas to use is air, but any other gas (e.g., nitrogen) that does not detrimentally affect the formation of fibers can be used.

In the exemplary design of FIG. 1, in addition to the power supply 26 that creates an electrical field, a compressed air supply 28 is used to create a flow of air (which may be referred to as "shaping fluid") that assists in directing the spinning solution 16 from the emitter toward the collector, forming separate fibrous streams from the spinning solution, vaporizing the solvent, and producing polymeric fibers 19 on the collector 14. The shaping fluid can flow from a single source or from multiple sources. The sources may be independent or dependent to one another. In one embodiment, the direction of the fibers towards the collector can be at least partially enabled by one or more sources of shaping fluid discharged from the emitter leading edge side opposite the emitter leading edge side emitting fibers.

The angle between the velocity vectors of the shaping fluid (e.g., air flow) and the emitted fibers can be at any angle relative to each other.

The flow rate of the compressed air supply 28 can be controlled, for example, by the use of a high pressure compressor, if desired. The gap between the emitter 12 and the housing 31 can be changed to influence both the fiber projection speed and the direction of trajectory.

In the exemplary design of FIG. 1, a frame 30 (e.g., fiberglass frame) is shown supporting the emitter 12, and the entire apparatus is within a container 31. Also, a flow of conditioned air 32 is provided that flows through the container 31 and surrounds the entire apparatus before exiting 34. This flow of conditioned air can be used to provide controlled environmental conditions of temperature and relative humidity.

The fibers 19 are collected on the collector 14 and formed into a fibrous web. The collector 14 can be conductive for creating an electrical field between it and the emitter 12, or an optional electrode (not shown). The collector 14 can be porous to allow the use of a vacuum device to pull vaporized solvent away from the fibers 19 and help pin the fibers 19 to the collector 14 to make the fibrous web.

Alternatively, a substrate 20 can be placed on the collector to collect the fibers. In this way, composite nonwoven materials can be produced. Such composite can be a filter structure. In such a structure, the fibers of the disclosure are formed on and adhered to a filter substrate (i.e., filtration substrate). Natural fiber and synthetic fiber substrates can be used as the filter substrate. Examples include spunbonded or melt-blown supports or fabrics, wovens and nonwovens of synthetic fibers, cellulosic materials, and glass fibers. Plastic screen-like materials, both extruded and hole punched, are other examples of filter substrates, as are ultra-filtration (UF) and micro-filtration (MF) membranes of organic polymers. Examples of synthetic nonwovens include polyester nonwovens, polyolefin (e.g., polypropylene) nonwovens, or blended nonwovens thereof. Sheet-like substrates (e.g., cellulosic or synthetic nonwoven webs) are the typical form of the filter substrates. The shape and structure of the filter material, however, is typically selected by the design engineer and depends on the particular filtration application. It should be understood that the type of substrate is not limiting in the present disclosure.

A variety of types of emitters can be used in a centrifugal electrospinning apparatus for carrying out the process of the present disclosure. The rotating elements of the emitter include, for example, a rotating portion, a rotating disc, a rotating bell, etc.

Figure 2:
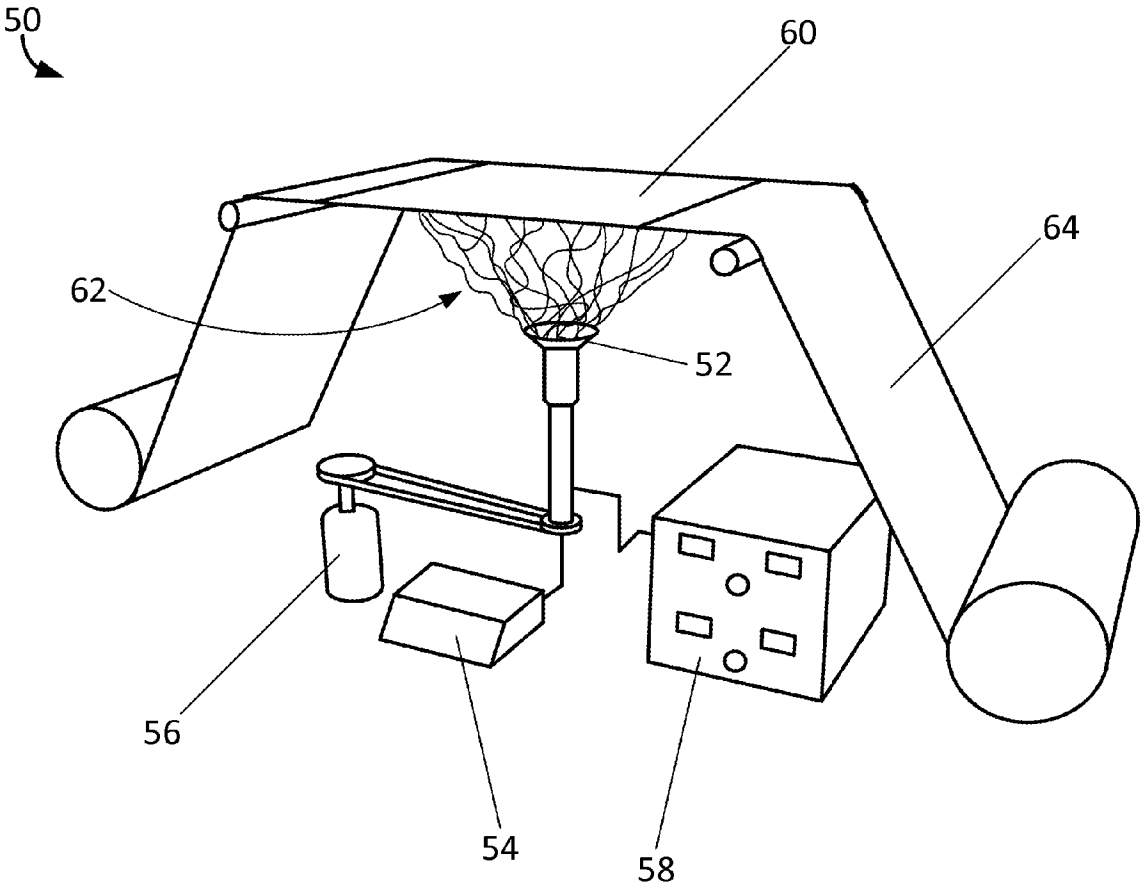
FIG. 2 is a schematic of an exemplary centrifugal electrospinning apparatus that uses a bell-style emitter.

Exemplary centrifugal electrospinning apparatus 50 including a bell style centrifugal electrospinning emitter 52 is shown in FIG. 2. Using this design, a polymer solution is pumped into the center of the bell-style emitter 52 using pump apparatus 54 (e.g., a syringe pump) while the emitter 52 is rotating at a high speed. As shown, an electric motor 56 is operatively coupled (e.g., using a belt) to a lower portion of the emitter 52 to rotate the emitter 52. The apparatus 50 further includes electrical apparatus 58 (e.g., high voltage aggregates) to provide an electrostatic field between the emitter 52 and the collector electrode 60 to assist in guiding the fibers 62 to the target on the substrate 64 proximate the collector electrode 60 while additionally elongating the fibers 62 in the process, as shown in FIG. 2.

An exemplary centrifugal electrospinning apparatus 100 is depicted in FIG. 3A. The centrifugal electrospinning apparatus 100 includes a rotating free-surface edge emitter 102 suitable for forming fibers from a spinning solution. Generally, the emitter 1102 may be referred to as a "rotating free-surface edge" emitter because the spinning solution may be discharged centrally onto a rotating surface such that the solution may travel, or crawl, along the rotating surface to the perimeter of the surface before being discharged therefrom. It may be described that the solution may move radially away from the center, or discharge location, of the emitter 102. Further, it may be described that the spinning solution is not discharged laterally, or from a side surface, of a rotating free-surface edge emitter. The traveling, or crawling, along the free-surface may extend, elongate, or stretch the fibers of the solution. For example, a spinning solution is pumped through a supply tube 104 running axially along rotation axis 101 through the emitter 102 and exits the supply tube. 104 to be directed into contact with a rotating free-surface and to travel along the free surface until it reaches a forward surface discharge edge, where it may be discharged towards the collector. While the solution travels, or crawls, across the free surface, the fibers of the solution may be elongated.

As shown, the emitter 102 includes a rotating element 106 that includes a discharge portion 120 depicted in more detail in 38 and a diffuser portion 130 depicted more detail in FIG. 3C. The discharge portion 120 defines an opening 122 and a rotating forward surface 124 configured to face a collector and configured to discharge the spinning solution therefrom. As shown, the forward surface 124 defines a concave shape including a perpendicular ring region 126 (e.g., about a 0.3 inch wide radial region located about 0.5 inches from center of the opening 122) that is perpendicular to the rotation axis 101. The perpendicular ring region 126 may be the only region of the forward surface that is perpendicular to the axis 101. The ring region 126 may be described as breaking-up a continuous curve defined by the forward surface 124. In other words, the forward surface 124 may not define a continuous curve. The forward surface 124 can be any conical-like shape having a generally concave inner surface, including a bell shape such as illustrated herein, a cup shape or even a frusto-conical shape. The cross section of the forward surface 124 can be straight or curved. The discharge portion 120 further includes a forward surface discharge edge 128 extending about the perimeter of the forward surface 124. The forward surface discharge edge 128 can be sharp or rounded and can include serrations or dividing ridges and configured for discharged the solution. For example, spinning solution may be issued through the tube 104, through the opening 122, and along the forward surface 124 toward and off of the forward discharge edge 128.

In this embodiment, the discharge portion 120 may define a radius (e.g., extending perpendicular to the axis extending along the opening 122) that is about 1.181 inches (e.g., a diameter of about 2.36 inches). In other embodiments, the radius may be greater than or less than about 1.181 inches such as, e.g., greater than about 0.25 inches, greater than about 0.5 inches, greater than about 0.75 inches, greater than about 1 inch, greater than about 1.25 inches, greater than about 1.5 inches, greater than about 2 inches, greater than about 3 inches, greater than about 5 inches, etc., and/or less than about 10 inches, less than about 8 inches, less than about 6 inches, less than about 4 inches, less than about 3 inches, less than about 2.5 inches, less than about 2 inches, less than about 1.5 inches, less than about 1.25 inches, less than about 1 inch, less than about 0.85 inches, less than about 0.65 inches, less than about 0.5 inches, etc.

The spinning solution is discharged through the diffuser portion 130 when being issued through the opening 122. As shown, the diffuser portion 130 is configured to mate with the discharge portion 120 to cover the opening 122 and be located proximate, or adjacent, the perpendicular ring region 126. The diffuser portion 130 may define a plurality of apertures 132 configured for the spinning solution to be discharged therethrough. As shown, each of the apertures 132 may be described as a half-moon recess extending into an edge of the diffuser portion 130 (e.g., defined by a radius of 0.472 inches and a 45 degree chamfer). Further, as shown, each of the apertures 132 may define an inverse conical shape, or horn, shaped to distribute the spinning solution onto the forward surface. 124 in a more uniform and spread apart fashion (e.g., forming a thinner layer). In this embodiment, the supply tube 104 may be defined through the center of the diffuser portion 130 and the spinning solution may exit the supply tube 104 through the openings 136.

Further, the exemplary centrifugal electrospinning apparatus to be used with the methods and/or processes described herein may be described as being nozzle-less or tube-less. In other words, the exemplary centrifugal electrospinning apparatus may not include nozzles in the traditional, or conventional, electrospinning lexicography or nomenclature. For example, some nozzle-type centrifugal electrospinning apparatus (or centrifugal electrospinning apparatus including nozzles) may have nozzles, tubes, and/or capillaries to distribute the spinning solution therethrough that extend from a rotating member.

Still further, in contrast to the exemplary centrifugal electrospinning apparatus described herein, centrifugal spinning apparatus may not include a rotating free-surface edge emitter such as, e.g., a spinneret style centrifugal spinning design that uses centrifugal forces and a set of designed spinnerets or nozzles to project the fibers horizontally, e.g., from a side surface (a surface generally parallel to the axis of rotation), or a rotary spinneret as described in U.S. Pat. Pub. No. 2011/0156319 (e.g., a mechanical gear drive system rotates the spinneret with the fibers being projected horizontally onto a media substrate on a collector drum).

Another emitter useful in a centrifugal electrospinning process as described herein is designed around a rotary spray head as described in U.S. App. Pat. Pub. No. 2010/0032872. In addition to centrifugal and electrostatic forces, this design uses air to control solvent evaporation rate and aerodynamic flight of the nanofibers. Although this is a "rotating free-surface edge" emitter, it is only disclosed as being used at a rotational speed of 10,000 revolutions per minute (rpm) and above.

Referring to FIG. 4, International Pub. No. 2009/079523 discloses another emitter useful in a centrifugal electrospinning process as described herein. This emitter includes a rotating spin disk 10 having a flat surface 11 and a forward surface discharge edge 12 mounted on a drive shaft 13 which is connected to a high speed motor (not shown). A spinning solution is pumped through a supply tube 14 running coaxially with drive shaft 13 and in close proximity to the center of spin disk 10 on the side of spin disk 10 opposite the side attached to drive shaft 13. As the spinning solution exits the supply tube 14, it is directed into contact with a rotating spin disk 10 and travels along the flat surface 11 so as to fully wet the flat surface 11 of the spin disk and to distribute the spinning solution as a film until it reaches forward surface discharge edge 12. The forward surface discharge edge 12 can be sharp or rounded and can include serrations or dividing ridges. The rotation speed of the spin disk 10 propels the spinning solution along flat surface 11 and past the forward surface discharge edge 12 to form separate fibrous streams, which are thrown off the discharge edge by centrifugal force. Simultaneously, the solvent vaporizes until fibers are formed. Although this is another "rotating free-surface edge" emitter, it is only disclosed as being used at a rotational speed of 4000 revolutions per minute (rpm) and above.

Another emitter useful in a centrifugal electrospinning process as described herein is shown in FIG. 5 and described in (Petrik, S., *Industrial Production Technology for Nanofibers*. European Cells and Materials. Nanofiber Production Properties and Functional Applications, October 2011, Pages 3-17). The spray atomizer has three heads to provide an atomizing technique.

Process Parameters

The process parameters that could affect media filtration efficiency and fiber diameter size for a centrifugal electrospinning process include, for example, polymer concentration of the spinning solution, viscosity of the spinning solution, temperature of the spinning solution, flow rate of the spinning solution, environmental conditions of the spinning environment (e.g., temperature and relative humidity), distance between the emitter and the collector, air flow rate to the emitter, rotational speed of the rotating element of the emitter, and electrical potential between the emitter and the collector. Typically, the primary process parameters that more significantly affect media efficiency and fiber diameter size for a centrifugal electrospinning process are polymer concentration of the spinning solution, flow rate of the spinning solution, distance between the emitter and the collector, rotational speed of the rotating element of the emitter, and electrical potential between the emitter and the collector. Of these, the polymer concentration of the spinning solution and the electrical potential (i.e., applied voltage) between the emitter and the collector have the most significant affect, particularly on filtration efficiency.

Typically, the spinning solution has a polymer concentration that can be within a wide range of values and can be determined readily by one of skill in the art depending on the intended result. In certain embodiments, the spinning solution has a polymer concentration of at least 1 wt-%, or at least 5 wt-%, or at least 7 wt-%, or at least 9 wt-%, based on the total weight of the solution. In certain embodiments, the spinning solution has a polymer concentration of up to 13 wt-%, or up to 20 wt-%, or up to 25 wt-%, or up to 35 wt-%, or up to 50 wt-%. Surprisingly, the polymer concentration of the spinning solution has a significant effect on the filtration efficiency of the resultant fibrous web. In certain embodiments, the spinning solution has a polymer concentration of 7 wt-% to 35 wt-%. In certain embodiments, the spinning solution has a polymer concentration of 7 wt-% to 25 wt-%. In certain embodiments, the spinning solution has a polymer concentration of 9 wt-% to 13 wt-%.

In order to assist the spinning of the spinning solution, the spinning solution can be heated or cooled. Typically, the temperature of the spinning solution is above the freezing point of the solution In certain embodiments, the spinning solution has a viscosity of at least 10 centipoise (cP). In certain embodiments, the spinning solution has a viscosity of up to 100 cP, or up to 1000 cP, or up to 6000 cP, or up to 10,000 cP. In certain embodiments, the spinning solution has a viscosity of 10 to 100 cP.

In certain embodiments, the rotational speed of the rotating element of the emitter (also referred to herein as the velocity of the spinning emitter) is 10,000 revolutions per minute (rpm) or less, or less than 10,000 rpm, or 4000 rpm or less, or less than 4000 rpm, or 3500 rpm or less, or 3000 rpm or less. In certain embodiments, the rotational speed of the rotating element of the emitter is at least 1000 rpm. In certain embodiments, the rotational speed of the rotating element of the emitter is 1000 to 4000 rpm.

In certain embodiments, the applied electrical field has a voltage potential (i.e., an applied voltage) of at least 1 kiloVolts (kV) and up to 150 kV. In certain embodiments, the applied voltage is at least 1 kV, or at least 20 kV, or at least 40 kV. In certain embodiments, the applied voltage is up to 80 kV, or up to 100 kV, or up to 150 kV. Surprisingly, the applied voltage has a significant effect on the filtration efficiency of the resultant fibrous web. In certain embodiments, the applied voltage is 40 to 80 kV for significant improvement of the filtration efficiency of the resultant fibrous web.

Typically, the flow rate (i.e., throughput rate) of the spinning solution can be within a wide range of values and can be determined readily by one of skill in the art depending on the intended result. In certain embodiments, the flow rate (i.e., throughput rate) of the spinning solution is greater than 0 milliliters per minute, or is at least 1 milliter per minute (ml/min), or at least 5 ml/min, or at least 10 ml/min. In certain embodiments, the flow rate of the spinning solution is up to 20 ml/min, or up to 25 ml/min, or up to 50 ml/min, or up to 100 ml/min. In certain embodiments, the flow rate of the spinning solution is 1-20 ml/min. In certain embodiments, the flow rate of the spinning solution is 10-100 ml/min.

Typically, the distance between the emitter and the collector can be varied over a wide range of values and can be determined readily by one of skill in the art depending on the intended result. In certain embodiments, the distance between the emitter and the collector is greater than 0 centimeters, or is at least 10 centimeters (cm), or at least 12 cm. In certain embodiments, the distance between the emitter and the collector is up to 30 cm, or up to 40 cm. In certain embodiments, the distance between the emitter and the collector is 12-30 cm.

Generally, the upper limit for the distance is governed by the balance of gravitational force, drag in the air through which the fibers travel after the discharge from the emitter, and electrostatic forces on the fibers such that the net of the balance of forces attracts the fibers to the collector. The magnitude of the electrical field can be important to the formation of fibers. For example, in certain embodiments, the magnitude of the electrical field can be less than 8 kV/cm, less than 6 kV/cm, or less than 4 kV/cm.

Typically, the environmental conditions surrounding the fiber-forming apparatus can be controlled to be within a wide range of conditions and can be determined readily by one of skill in the art depending on the intended result. The environmental conditions (e.g., temperature and relative humidity) surrounding the fiber-forming apparatus can be controlled, for example, by the use of conditioned air. Thus, the process of the present disclosure can be carried out under controlled environmental conditions. In certain embodiments, the relative humidity is at least 30%, or at least 35%. In certain embodiments, the relative humidity is up to 50%, or up to 45%. In certain embodiments, the temperature is at least 60° F., or at least 70° F. In certain embodiments, the temperature is up to 80° F., or up to 90° F.

The compressed air supply can be controlled to provide an air flow to the emitter of at least 2 scfm, or at least 3 scfm. The compressed air supply can be controlled to provide an air flow to the emitter of up to 10 scfm, or up to 12 scfm, or even higher if a high pressure compressor is used.

FIG. 6 shows SEM images of low efficiency and high efficiency filtration media with nanofibers applied by an exemplary centrifugal electrospinning process of the present disclosure.

Method for Determining Process Parameters

The present disclosure also provides a method of determining the above-identified process parameters for a centrifugal electrospinning process described herein.

More specifically, the present disclosure provides a method of determining the significance of independent variables in centrifugal electrospinning. This method includes: providing a plurality of independent variables for a centrifugal electrospinning process; providing at least one desired response variable; running a plurality of tests for the centrifugal electrospinning process resulting in test data, wherein at least one independent variable has a different value for each test; identifying at least one significant independent variable from the plurality of independent variables for providing the at least one desired response variable by analyzing the test data using response surface methodology (RSM); and validating an operability region of the at least one significant independent variable using an artificial neural network (ANN).

The method may further include determining an operability region for the at least one significant independent variable using a method of steepest ascent. Furthermore, the method may further include validating an operability region of the at least one significant independent variable using an artificial neural network (ANN) by training the ANN using a first portion of the test data, and testing a second portion of the test data using the ANN to provide the operability region of the at least one significant independent variable.

Exemplary Embodiments

1. A fiber-forming process comprising:

providing a centrifugal electrospinning apparatus comprising:

a rotating free-surface edge emitter comprising a rotating element having a rotational speed of 4,000 rpm or less; and a collector; and providing a spinning solution comprising at least one polymer dissolved in at least one solvent;

supplying the spinning solution to the emitter; and directing the spinning solution from the emitter toward the collector under conditions effective to form separate fibrous streams from the spinning solution, vaporize the solvent, and produce polymeric fibers on the collector.

2. The process of embodiment 1 further comprising providing a voltage potential of at least 40 kV between the emitter and the collector.

3. The process of embodiment 1 or 2 further comprising providing a voltage potential of up to 80 kV between the emitter and the collector.

4. The process of embodiments 1 through 3 wherein the magnitude of the electrical field is less than 8 kV/cm.

5. The process of any of embodiments 1 through 4 wherein the rotating element of the emitter has a rotational speed of 3500 rpm or less.

6. The process of embodiment 5 wherein the rotating element of the emitter has a rotational speed of 3000 rpm or less.

7. The process of any of embodiments 1 through 6 wherein the rotating element of the emitter has a rotational speed of at least 1000 rpm.

8. The process of any of embodiments 1 through 7 wherein the rotating element defines a forward surface facing the collector configured to discharge the spinning solution centrally therefrom.

9. The process of embodiment 8 wherein:

the forward surface is a concave forward surface and defines a forward surface discharge edge; and the step of issuing the spinning solution from the emitter comprises issuing the spinning solution centrally and along the concave forward surface so as to distribute said spinning solution toward the forward surface discharge edge.

10. The process of any of embodiments 1 through 9 wherein the directing step comprises directing the spinning solution from the emitter toward the collector in a direction against gravity.

11. The process of any of embodiments 1 through 10 wherein the spinning solution has a viscosity of up to 1000 centipoise.

12. The process of embodiment 11 wherein the spinning solution has a viscosity of up to 100 centipoise.

13. The process of any of embodiments 1 through 12 wherein the spinning solution has a viscosity of at least 10 centipoise.

14. The process of any of embodiments 1 through 13 wherein the spinning solution has a concentration of polymer dissolved in solvent of at least 7 wt-%.

15. The process of any of embodiments 1 through 14 wherein the spinning solution has a concentration of polymer dissolved in solvent of at least 9 wt-%.

16. The process of any of embodiments 1 through 15 wherein the spinning solution has a concentration of polymer dissolved in solvent of up to 13 wt-%.

17. The process of any of embodiments 1 through 16 wherein the spinning solution has a concentration of polymer dissolved in solvent of up to 25 wt-%.

18. The process of any of embodiments 1 through 17 wherein supplying the spinning solution to the emitter occurs at a throughput rate of at least 1 ml/min.

19. The process of any of embodiments 1 through 18 wherein supplying the spinning solution to the emitter occurs at a throughput rate of at least 10 ml/min.

20. The process of any of embodiments 1 through 19 wherein supplying the spinning solution to the emitter occurs at a throughput rate of up to 100 ml/min.

21. The process of any of embodiments 1 through 20 wherein the emitter and the collector are positioned to have a distance between them of at least 12 cm.

22. The process of any of embodiments 1 through 21 wherein the emitter and the collector are positioned to have a distance between them of up to 30 cm.

23. The process of any of embodiments 1 through 22 which is carried out under controlled environmental conditions of temperature and relative humidity.

24. The process of embodiment 23 wherein the relative humidity is 35% to 45%.

25. The process of embodiment 23 or 24 wherein the temperature 70° F. to 80° F.

26. The process of any of embodiments 1 through 25 wherein air is supplied to the emitter at a rate of at least 3 scfm.

27. The process of any of embodiments 1 through 26 wherein air is supplied to the emitter at a rate of up to 12 scfm.

28. The process of any of embodiments 1 through 27 wherein the polymer is selected from the group of polyalkylene oxides, poly(meth)acrylates, polystyrene based polymers and copolymers, vinyl polymers and copolymers, fluoropolymers, polyesters and copolyesters, polyurethanes, polyalkylenes, polyamides, polyaramids, thermoplastic polymers, liquid crystal polymers, engineering polymers, biodegradable polymers, bio-based polymers, natural polymers, and protein polymers.

29. The process of any of embodiments 1 through 28 wherein the spinning solution can be heated or cooled.

30. The process of any of embodiments 1 through 29 wherein the fibers have an average fiber diameter of less than 2,000 nm.

31. The process of any of embodiments 1 through 30 wherein the fibers have an average fiber diameter of less than 1,000 nm.

32. The process of any of embodiments 1 through 31 wherein the fibers have an average fiber diameter of greater than 40 nm.

33. The process of embodiment 31 wherein the average fiber diameter is 100 nm to 500 nm.

34. The process of any of embodiments 1 through 33 further comprising collecting the fibers on a substrate.

35. The process of embodiment 34 wherein the substrate is a cellulose nonwoven.

36. A fiber-forming process comprising:

providing a centrifugal electrospinning apparatus comprising:

a rotating free-surface edge emitter comprising a rotating element having a rotational speed of 10,000 rpm or less;

a collector; and a voltage potential of 40-80 kV between the emitter and the collector;

providing a spinning solution having a viscosity of up to 1000 centipoise, the solution comprising at least one polymer dissolved in at least one solvent at a concentration of 9-13 wt-%;

supplying the spinning solution to the emitter at a throughput rate of 10-100 ml/min.; and directing the spinning solution from the emitter toward the collector under conditions effective to form separate fibrous streams from the spinning solution, vaporize the solvent, and produce polymeric fibers on the collector.

37. The process of embodiment 36 wherein the rotating element of the emitter comprises a rotating spin disk or a rotating bell.

38. The process of embodiment 36 or 37 wherein the rotating element of the emitter has a rotational speed of 3500 rpm or less.

39. The process of any of embodiments 36 through 38 wherein the spinning solution has a viscosity of up to 1000 centipoise.

40. A method of determining the significance of independent variables in centrifugal electrospinning:

providing a plurality of independent variables for a centrifugal electrospinning process;

providing at least one desired response variable;

running a plurality of tests for the centrifugal electrospinning process resulting in test data, wherein at least one independent variable has a different value for each test;

identifying at least one significant independent variable from the plurality of independent variables for providing the at least one desired response variable by analyzing the test data using response surface methodology (RSM); and validating an operability region of the at least one significant independent variable using an artificial neural network (ANN).

41. The method of embodiment 34 further comprising determining an operability region for the at least one significant independent variable using a method of steepest ascent.

36. The method of embodiment 34 or 35 wherein validating an operability region of the at least one significant independent variable using an artificial neural network (ANN) comprises:

training the ANN using a first portion of the test data; and testing a second portion of the test data using the ANN to provide the operability region of the at least one significant independent variable.

EXAMPLES

Objects and advantages of this disclosure are further illustrated by the following examples, but the particular materials and amounts thereof recited in these examples, as well as other conditions and details, should not be construed to unduly limit this disclosure.

Efficiency Test

When reference is made to efficiency or LEFS efficiency (Low Efficiency Flat Sheet), unless otherwise specified, reference is to efficiency when measured according to ASTM-1215-89, with 0.78 micron (μ) monodisperse polystyrene spherical particles, at 20 fpm (feet per minute, 6.1 m/min). For example, test process injects 0.8 micron particles into a non-static air stream that passes through a 4" diameter media sample. Upstream and downstream particle counters are used to compute the ratio of counted particles which results in a percent efficiency. A Gage R&R study was conducted which indicated an accuracy of +/−1.5%.

Method of Fiber Diameter Measurement

The fiber diameter was measured using Phenom G2 Pro SEM with a Cressington 108 gold sputter coater, which has magnification range 20×-45,000×, may generate images up to 2048×2048 pixels, 2.9 nm, and may load samples in less than 30 seconds. Also, it should be noted that the actual diameter recorded may have been somewhat lower since the fibers are sputtered with gold in order to avoid electrostatic charging by the electron beam in the SEM. The thickness of the gold layer can be estimated to be in the range 10-50 nm (20-100 nm on the diameter).

When measuring the fiber diameter, the sample size may have a ½" (i.e., ⅕ inch) diameter. For each trial, 1-5 samples were taken and the Cressington gold sputter time was about 30 seconds. The SEM Magnification 9200× was set to 9,500× and about 4 images were taken per sample. Phenom Pro Suite Fibermetric was used as the fiber sizing software. A minimum of 40 data points, or number of fiber selections, were made per sample. Some fiber selections were omitted due to, e.g., fiber intersections, non-fiber selections, adjacent selections, poor focus selections with high standard deviation, morphology anomalies, etc. From the combined results of four images per trial, mean fiber diameter, minimum diameter, and maximum diameter were calculated.

Viscosity Measurement

The viscosity was measured using a Cole Parmer water bath and a Brookfield viscometer. First, the water reservoir was turned on and the temperature set to 77 F. Next, using a syringe, 16 milliliters was pulled out of the poly can and placed into a viscosity test container. The test container was placated onto a viscosity tester with the spindle located in the tube. Then, the test assembly was lowered into water (additionally, e.g., the assembly was centered and the temperature was confirmed to be 77° F.). Next, the test was turned on such that the spindle was turning and the timer was set to 5 minutes. After 5 minutes, viscosity results may be read and logged. Afterwards, the container and spindle were cleaned with alcohol.

Media Substrate and Polymer Solution

Media Substrate

Cellulose Grade Air Filtration—Flat

Basis Weight (g/m$^2$)—51.0

Substrate Efficiency—20.997

Thickness (in)—0.0115

Media Width—24 inches

Polymer Solution

Nylon copolymer resin (SVP 651 obtained from Shakespeare Co., Columbia, S.C., a terpolymer having a number average molecular weight of 21,500-24,800 comprising 45% nylon-6, 20% nylon-6,6 and 25% nylon-6,10) solutions were prepared by dissolving the polymer in alcohol (ethanol, 190 proof) and heating to 60° C. to produce a solids solution (e.g., ranging from about 9% solids to about 13% solids such as 9.6%). After cooling, to the solution was added a melamine-formaldehyde resin (i.e., crosslinking agent) (CYMEL 1133 obtained from Cytec Industries of West Paterson, N.J.). The weight ratio of melamine-formaldehyde resin to nylon was 40:100 parts by weight. Additionally, to the solution was added para-toluene sulfonic acid (7%, based on polymer solids). The solution was agitated until uniform and was then electrospun to form a layer of fine fiber on a filtration substrate.

Experimental Process to Determine Process Parameters

Initial process parameters were adjusted until fibers were produced less than one micron. A Scanning Electron Microscope (SEM) was used to evaluate the fiber diameters. When the setup was validated, the initial independent and dependent process variables were documented along with the media efficiency and the minimum fiber diameter.

Example 1

The primary process parameters were optimized using Response Surface Methodology (RMS) as described in Myers, R. H., D. C. Montgomery, and C. M. Anderson-Cook, *Response surface methodology: process and product optimization using designed experiments*. Vol. 705. 2009: John Wiley & Sons Inc.; Raissi, S. and R. E. Farsani, *Statistical process optimization through multi-response surface methodology*. World Academy of Science, Engineering and Technology, 2009. 51(46): p. 267-271; Kleijnen, J. P. C., *Response surface methodology for constrained simulation optimization: An overview*. Simulation Modelling Practice and Theory, 2008. 16(1): p. 50-64; and Chen, L. J., *Integrated robust design using response surface methodology and constrained optimization* (2008). The RSM was carried in three sequential steps: (1) screen important independent variables, (2) apply a first-order model and the method of steepest ascent/descent to move the process toward the optimum solution; and then apply a higher-order polynomial to accurately approximate a relatively small region around the optimum The response variables were determined to be:

Response Variable (Primary):

$y_0$—Media Efficiency

Response Variable (Secondary):

$y_1$—Minimum polymer fiber diameter (nm)

Response Variable (Alternate):

$y_2$—Mean polymer fiber diameter (nm);

$y_3$—Maximum polymer fiber diameter (nm);

$y_4$—Range of polymer fiber diameter (nm);

$y_5$—Percent of polymer fiber diameters less than 500 nm.

The first set of independent variables were polymer Concentration (wt %), velocity of spinning emitter (RPM), applied Voltage (kV), Polymer flow rate (ml/min), the distance between emitter and collector (cm), relative Humidity (water & solvent %) (note: a certain density of vaporized solvents in the air can impact the measurement of water molecules when testing for humidity), temperature (F), and air flow rate to emitter (scfm).

A second set of independent variables were fixed for during the experiments: the type of geometry of emitter was conical (e.g., the emitter of FIGS. 3A-3C was used), the collector configuration was flat, the velocity of the substrate was held at 10 fpm, and air turns in experimental test environment was held at 20.

The ranges of the independent variables were as follows:

$x_1$—Polymer Concentration (wt %): $9 \le x_1 \le 13$. The accuracy of the percent solids is estimated at +/−0.1% due to variability in chemicals and mixing process.

$x_2$—Velocity of spinning emitter (RPM): $1{,}000 \le x_2 \le 5{,}000$. The testing apparatus was designed to work at a maximum of 50K rpm if needed. The speed increments were limited to 250 rpm because a 4:1 gear reduction was used to apply sufficient torque to the drive system.

$x_3$—Applied Voltage (kV): $40 \le x_3 \le 80$. The accuracy of the applied voltage was +/−0.1 kV.

$x_4$—Polymer flow rate (ml/min): $10 \le x_4 \le 25$ This limit is based on the speed of the substrate. Trials were only conducted at 10 FPM. Higher substrate speeds would allow this upper limit to be much higher. The range could be expanded by adding an additional pump. A positive displacement pump with a variable speed motor was used. A flow rate accuracy study was conducted which indicted a +/−0.1 ml/min measurement accuracy.

$x_5$—Distance between emitter and collector (cm): $12 \le x_5 \le 30$. The accuracy of this measurement was +/−0.25 cm.

$x_6$—Relative Humidity (water & % solvent in air): $35 \le x_6 \le 45$. The accuracy of this measurement was +/−2%.

$x_7$—Temperature (F): $70 \le x_7 \le 80$. The accuracy of this measurement was +/−2° F.

$x_8$—Air flow rate to emitter (scfm): $3 \le x_8 \le 11.2$ The range could be expanded by adding a high pressure compressor. The accuracy of this measurement was +/−0.1 scfm which was based on the purchased flow meter gage specifications and the resolution of the gage readout display.

The linear regression model between response γ and design variables x is described as:

$$\gamma=\beta_0+\beta_1x_1+\beta_2x_2+\ldots+\beta_kx_k+\epsilon \quad (3\text{-}2)$$

where ϵ is the residual error.

If there is interaction between the independent variables, an interaction term can be added to equation 3-2. The equation would then looks as follows:

$$\gamma=\beta_0+\beta_1x_1+\beta_2x_2+\beta_{12}x_1x_2+\ldots+\beta_kx_k+\beta_kx_kx_{k+1}+\epsilon \quad (3\text{-}3)$$

A higher degree polynomial was also used to better estimate the functional relationship. A second-order model is given as:

$$\gamma=\beta_0+\Sigma_{i=0}^{K}\beta_ix_i+\Sigma_{i=0}^{K}\beta_{ii}x_i^2+\Sigma_{i>j}\beta_{ij}x_ix_j+\epsilon \quad (3\text{-}4)$$

A screening experiment was performed to study the independent variables and aims to eliminate the insignificant variables so further experiments can be conducted more efficiently. A $2^k$ factorial designs was applied to factor screening experiments.

After significant independent variables and interactions are determined from the screening experiment, the method of steepest ascent (or descent) is used. This process determines the direction and gradient that the significant variables should move to find a region of the target response.

The initial independent variable values used to setup the test apparatus to produce the defined response variable (y) with a value less than 1000 nm was considered the initial center point for each factor. $\beta_0$ represents the fixed intercept of the plane. $\beta_i$, i=1, 2, . . . are called the partial regression coefficients. The corner points defining the minimum and maximum was a small percent of the range of the independent natural variable with respect to the initial center point. For convenience, the natural variables were converted to coded variables. This first-order coded variable model is referred to as a main effects model. The $3^{rd}$ order interaction terms are excluded from the initial main effects model. The statistical error term E is set to zero. The initial high, low, and center point test matrix is shown below.

TABLE 1

Initial Test Matrix

| Natural Factors | Low (−1) | Center (0) | High (+1) |
|---|---|---|---|
| A: Polymer Concentration (wt %) | $x_{1,L0}$ | $x_{1,C0}$ | $x_{1,H0}$ |
| B: Velocity of spinning emitter (RPM) | $x_{2,L0}$ | $x_{2,C0}$ | $x_{2,H0}$ |
| C: Applied Voltage (kV) | $x_{3,L0}$ | $x_{3,C0}$ | $x_{3,H0}$ |
| D: Polymer flow rate (ml/min) | $x_{4,L0}$ | $x_{4,C0}$ | $x_{4,H0}$ |
| E: Distance between emitter and collector (cm) | $x_{5,L0}$ | $x_{5,C0}$ | $x_{5,H0}$ |
| F: Relative Humidity (water & solvent %) | $X_{6,L0}$ | $X_{6,C0}$ | $X_{6,H0}$ |
| G: Temperature (F.) | $X_{7,L0}$ | $X_{7,C0}$ | $X_{7,H0}$ |
| H: Air flow rate to emitter (scfm) | $x_{8,L0}$ | $x_{8,C0}$ | $x_{8,H0}$ |

A factional factorial design was selected initially to reduce the numbers of runs while identifying the insignificant factors. A $2_{IV}^{8-3}$ fractional factorial design was selected that required 32 runs conducted in a random order. Two replicates were conducted along with five center point replications. The natural factors for A, B, C, and D were selected first because the research indicated that these variables might have a higher significance. The generators chosen are positive. The following table illustrates the initial coded $2_{IV}^{8-3}$ fractional factorial design representing the initial Design of Experiments.

TABLE 2

Initial coded fractional factorial design

| Std Run Order (i) | Basic Design Factor A | Factor B | Factor C | Factor D | Factor E | Factor F = ABC | Factor G = ABD | Factor H = BCDE | Labels | Response y |
|---|---|---|---|---|---|---|---|---|---|---|
| 1 | − | − | − | − | − | − | − | + | fghj | |
| 2 | + | − | − | − | − | + | + | + | af | |
| 3 | − | + | − | − | − | + | + | − | bg | |
| 4 | + | + | − | − | − | − | − | − | abhj | |
| 5 | − | − | + | − | − | + | − | − | ch | |
| 6 | + | − | + | − | − | − | + | − | acgj | |
| 7 | − | + | + | − | − | − | + | + | bcfg | |
| 8 | + | + | + | − | − | + | − | + | abcfgh | |
| 9 | − | − | − | + | − | − | + | − | dj | |
| 10 | + | − | − | + | − | + | − | − | adgh | |
| 11 | − | + | − | + | − | + | − | + | bdfh | |
| 12 | + | + | − | + | − | − | + | + | abdfgj | |
| 13 | − | − | + | + | − | + | + | + | cdfg | |
| 14 | + | − | + | + | − | + | + | + | acdfhj | |
| 15 | − | + | + | + | − | + | + | − | bcdghj | |
| 16 | + | + | + | + | − | + | + | − | abcd | |
| 17 | − | − | − | − | + | − | − | − | e | |
| 18 | + | − | − | − | + | − | − | − | aeghj | |
| 19 | − | + | − | − | + | − | − | + | befhj | |
| 20 | + | + | − | − | + | − | − | + | abefg | |
| 21 | − | − | + | − | + | + | − | + | cefgj | |
| 22 | + | − | + | − | + | + | − | + | acefh | |
| 23 | − | + | + | − | + | + | − | − | bcegh | |
| 24 | + | + | + | − | + | + | − | − | abcej | |
| 25 | − | − | − | + | + | − | + | + | defgh | |
| 26 | + | − | − | + | + | − | + | + | adefj | |
| 27 | − | + | − | + | + | − | + | − | bdegj | |
| 28 | + | + | − | + | + | − | + | − | abdeh | |
| 29 | − | − | + | + | + | + | + | − | cdehj | |
| 30 | + | − | + | + | + | + | + | − | acdeg | |
| 31 | − | + | + | + | + | + | + | + | bcdef | |
| 32 | + | + | + | + | + | + | + | + | abcdefghj | |

When the 69 runs were completed, a Main Effects Analysis was generated using Minitab software. Normal probability and residual plots were generated to determine the significant effects. This information was used to reduce insignificant factors and interactions. The second Main Effects Model was generated within the first Main Effects cube to mitigate potential concerns of curvature in the original Main Effects cube.

The method of steepest ascent was used to determine the gradient or direction at which the variables can move the most rapid toward the optimized response surface.

A second Effects Model was generated at the maximum response of steepest ascent. The second Effects Model required a smaller second Effect Model because the initial results of the second Effects Model indicated this cube was possibly too large. A second steepest ascent was then used to determine the gradient or direction at which the variables can move the most rapid toward the optimized response surface. A second-order model or higher-order polynomial model was then generated to accurately approximate the true response function within the localized operability region.

Based on the initial startup test results, the following independent variable settings were established as the initial high, low and center point values.

TABLE 3

Initial High, Low, and Center Point Values

| DOE1a | % Solids | Motor Speed RPM | Voltage KV | Pump Rate ml/min | Field Gap cm | Humidity % | Temp F. | Air flow SCFM |
|---|---|---|---|---|---|---|---|---|
| Low | 11.0 | 3000 | 30.0 | 12.5 | 20.3 | 38.0 | 69.0 | 9.0 |
| Center | 12.0 | 3500 | 40.0 | 15.0 | 25.4 | 40.0 | 72.0 | 10.0 |
| High | 13.0 | 4000 | 50.0 | 17.5 | 30.5 | 42.0 | 75.0 | 11.0 |

The ranges for the initial high and low points were chosen based on a step size of one for the percent solids variable. The following table illustrates how the initial high and low point values consume the feasible variable range for each variable.

TABLE 4

Main Effects Model—Feasibility Variable Range

| Feasible Variable Range | % Solids | Motor Speed | Voltage | Pump Rate | Field Gap | Humidity | Temp | Air flow |
|---|---|---|---|---|---|---|---|---|
| Min | 9.0 | 1000 | 40.0 | 10.0 | 12.0 | 35.0 | 60.0 | 3.0 |
| Max | 13.0 | 5000 | 80.0 | 25.0 | 30.0 | 45.0 | 80.0 | 11.2 |

TABLE 4-continued

| Main Effects Model—Feasibility Variable Range | | | | | | | | |
|---|---|---|---|---|---|---|---|---|
| Feasible Variable Range | % Solids | Motor Speed | Voltage | Pump Rate | Field Gap | Humidity | Temp | Air flow |
| % of Range | 50% | 25% | 50% | 33% | 56% | 40% | 30% | 24% |
| % to Min (Center pt) | 75% | 63% | 0% | 33% | 74% | 50% | 60% | 85% |
| % to Max (Center Pt) | 25% | 38% | 100% | 67% | 26% | 50% | 40% | 15% |

The 69 experimental trials were conducted based on the $2_{IV}^{8-3}$ fractional factorial design. The trial data was imported into Minitab in order to perform the Design of Experiment Main Effects Analysis. The following $2_{IV}^{8-3}$ fractional factorial design was used for the Main Effects Analysis.

Fractional Factorial Design
Factors: 8 Base Design: 8, 32 Resolution: IV
Runs: 69 Replicates: 2 Fraction: ⅛
Blocks: 1 Center pts (total): 5
Design Generators: F=ABC, G=ABD, H=BCDE
Alias Structure (up to order 4)
I+ABCF+ABDG+CDFG
A+BCF+BDG+CEGH+DEFH
B+ACF+ADG+CDEH+EFGH
C+ABF+DFG+AEGH+BDEH
D+ABG+CFG+AEFH+BCEH
E+ACGH+ADFH+BCDH+BFGH
F+ABC+CDG+ADEH+BEGH
G+ABD+CDF+ACEH+BEFH
H+ACEG+ADEF+BCDE+BEFG
AB+CF+DG
AC+BF+EGH+ADFG+BCDG
AD+BG+EFH+ACFG+BCDF
AE+CGH+DFH+BCEF+BDEG
AF+BC+DEH+ACDG+BDFG
AG+BD+CEH+ACDF+BCFG
AH+CEG+DEF+BCFH+BDGH
BE+CDH+FGH+ACEF+ADEG
BH+CDE+EFG+ACFH+ADGH
CD+FG+BEH+ABCG+ABDF
CE+AGH+BDH+ABEF+DEFG
CG+DF+AEH+ABCD+ABFG
CH+AEG+BDE+ABFH+DFGH
DE+AFH+BCH+ABEG+CEFG
DH+AEF+BCE+ABGH+CFGH
EF+ADH+BGH+ABCE+CDEG
EG+ACH+BFH+ABDE+CDEF
EH+ACG+ADF+BCD+BFG
FH+ADE+BEG+ABCH+CDGH
GH+ACE+BEF+ABDH+CDFH
ABE+CEF+DEG+ACDH+AFGH+BCGH+BDFH
ABH+CFH+DGH+ACDE+AEFG+BCEG+BDEF
ACD+AFG+BCG+BDF+ABEH+CEFH+DEGH
Alias Information for Terms in the Model.
Totally confounded terms were removed from the analysis.
A*B+C*F+D*G
A*C+B*F
A*D+B*G
A*F+B*C
A*G+B*D
C*D+F*G
C*G+D*F The Normal Plot of the Full Main Effects results is shown in FIG. 7. The four main residual plots for the efficiency response are shown in FIG. 8. This plot was generated by the use of Minitab software.

A screening experiment was used to eliminate insignificant factors and interactions. An alpha limit of $\alpha>0.05$ was used to reduce the analysis model. From the reduced model Effects Analysis results for the primary response media efficiency, the percent solids and the applied voltage factors are the most significant and the interaction of these two factors is also the most significant interaction. The Normal Plot results of the reduced Main Effects model are shown if FIG. 9. The four main residual plots for the efficiency response of the reduced model are shown in FIG. 10. This plot was generated by the use of Minitab software.

A method of steepest ascent was then performed to determine the direction and gradient that the significant variables should move to toward the maximum media efficiency response. The step size was selected to be 0.5 and the percent solids variable was chosen as the base. A steepest ascent macro was used in Minitab to generate the values of each dependent variable for each step. The results of the Minitab Steepest Ascent macro are given below.

| Path of Steepest Ascent Overview | |
|---|---|
| Total # of Runs | 7 |
| Total # of Factors | 8 |
| Base Factor Name | % Solids_1 |
| Step Size Base Factor by | 0.50000 |
| Coded Coefficient of Base Factor | −1.94890 |

| Factor Name | Coded Coef. | Low Level | High Level |
|---|---|---|---|
| % Solids_1 | −1.94890 | 11 | 13 |
| Motor RPM_1 | 0.20433 | 3 | 4 |
| KV_1 | 1.91006 | 30 | 50 |
| Pump Rate_1 | 0.42431 | 5 | 7 |
| Field Gap_1 | −1.63425 | 8 | 12 |
| Humidity_1 | 0.43876 | 37 | 42 |
| Temp_1 | −0.20008 | 69 | 75 |
| Air flow_1 | 1.24879 | 9 | 11 |

A table of the uncoded steepest ascent variables is shown below in Table 5 along with the average primary response result.

Steepest Ascent

TABLE 5

| Initial Steepest with Ascent Primary Response | | | | | | | | | |
|---|---|---|---|---|---|---|---|---|---|
| Step = .5 Base = % Solids | % Solids | Motor Speed | KV | Pump Rate | Field Gap | Humidity | Temp | Air flow | Efficiency % Response |
| Step 0 | 12.0 | 3,500 | 40.0 | 15.0 | 25.4 | 39.5 | 72.0 | 10.0 | 23.857 |
| Step 1 | 11.5 | 3,500 | 44.9 | 15.3 | 23.3 | 39.8 | 71.9 | 10.3 | 30.892 |
| Step 2 | 11.0 | 3,500 | 49.8 | 15.6 | 21.1 | 40.1 | 71.7 | 10.6 | 36.225 |

TABLE 5-continued

| Initial Steepest with Ascent Primary Response | | | | | | | | | |
|---|---|---|---|---|---|---|---|---|---|
| Step = .5 Base = % Solids | % Solids | Motor Speed | KV | Pump Rate | Field Gap | Humidity | Temp | Air flow | Efficiency % Response |
| Step 3 | 10.5 | 3,500 | 54.7 | 15.8 | 19.0 | 40.3 | 71.5 | 11.0 | 40.518 |
| Step 4 | 10.0 | 3,750 | 59.6 | 16.1 | 16.9 | 40.6 | 71.4 | 11.0 | 42.336 |
| Step 5 | 9.5 | 3,750 | 64.5 | 16.4 | 14.8 | 40.9 | 71.2 | 11.0 | 44.573 |
| Step 6 | 9.0 | 3,750 | 69.4 | 16.6 | 12.6 | 41.2 | 71.1 | 11.0 | 37.465 |

The motor speed variable was rounded to the nearest interval of 250 rpm. The variable speed control used in the experiments was limited to this incremental range. At step 3 of the steepest ascent, the air flow variable reached the upper limit of 11.0 scfm. Three replications of each step were conducted to determine an average and standard deviation for each step.

TABLE 6

| Initial Steepest Ascent—Primary Response Results | | | | | | | |
|---|---|---|---|---|---|---|---|
| Steepest Ascent | Efficiency Response | Std Dev | Trial 1 | Trial 2 | Trial 3 | Trial 4 | Trial 5 |
| Step 0 | 23.857 | 0.520 | 23.916 | 23.276 | 24.690 | 23.680 | 23.721 |
| Step 1 | 30.892 | 0.590 | 30.211 | 31.201 | 31.263 | | |
| Step 2 | 36.225 | 0.494 | 36.214 | 35.736 | 36.724 | | |
| Step 3 | 40.518 | 1.268 | 41.819 | 39.285 | 40.449 | | |
| Step 4 | 42.336 | 0.401 | 42.759 | 42.287 | 41.961 | | |
| Step 5 | 44.573 | 0.276 | 44.846 | 44.295 | 44.577 | | |
| Step 6 | 37.465 | 1.578 | 36.100 | 37.101 | 39.193 | | |

At step 5 of the steepest ascent, the efficiency stopped increasing which indicated a local maximum response. 95% Confidence Intervals were generated for both the primary response (Efficiency) and the secondary response (Smallest Fiber Diameter). FIG. 11 illustrates the confidence intervals for the efficiency response and FIG. 12 illustrates the confidence intervals for the smallest fiber diameter.

The confidence interval of the efficiency at step 5 of the steepest ascent is where the local maximum response was determined. Because the range of the smallest fiber diameter increased as the efficiency increased, the confidence interval progressively increased with each step of the steepest ascent.

The secondary and alternate response results of the steepest ascent are shown in the following table:

TABLE 7

| Response Results - Steepest Ascent | | | | | |
|---|---|---|---|---|---|
| Steepest Ascent | Efficiency Response | Mean | Min | Max | Range |
| Step 0 | 23.857 | 444.53 | 161.14 | 1058.37 | 897.23 |
| Step 1 | 30.892 | 419.29 | 119.12 | 1052.34 | 933.22 |
| Step 2 | 36.225 | 400.90 | 128.40 | 1136.18 | 1007.79 |
| Step 3 | 40.518 | 390.13 | 127.82 | 1023.92 | 896.09 |
| Step 4 | 42.336 | 491.74 | 143.01 | 1368.33 | 1225.32 |
| Step 5 | 44.573 | 431.70 | 108.07 | 1227.23 | 1119.16 |
| Step 6 | 37.465 | 522.13 | 144.46 | 1312.22 | 1167.75 |

An SEM image of the fiber morphology each step of the Steepest Ascent is shown in FIG. 13. The density of fibers is clearly shown to increase at each step of the Steepest Ascent. The range and size of fibers observed appears to be consistent with the analytical fiber analysis conducted using the Phenom Fibermetric software. The results of the Method of Steepest Ascent indicate that step 5 is a local optimum region.

Example 2

Experimental data was collected during the RSM trials. Since ANN models do not extrapolate very well, it was important to have experimental runs that tested the extensibility of the variable ranges.

Based on the research, the following test parameters were used as a starting point to establish a baseline for developing the initial two-level fractional factorial design.

TABLE 8

| Initial Test Startup Parameters | | | | | | | | |
|---|---|---|---|---|---|---|---|---|
| | % Solids % | Motor Speed RPM | Voltage KV | Pump Rate ml/min | Field Gap Cm | Humidity % | Temp F. | Air flow SCFM |
| | Basic Design | | | | | | | |
| Std Run Order (i) | Factor A | Factor B | Factor C | Factor D | Factor E | Factor F = ABC | Factor G = ABD | Factor H = BCDE |
| P1 | 13 | 3000 | 30 | 15 | 30 | 42 | 72 | 11.0 |
| P2 | 13 | 3000 | 30 | 13 | 20 | 42 | 72 | 11.0 |
| P3 | 13 | 2000 | 30 | 13 | 20 | 39 | 73 | 11.0 |
| P4 | 13 | 2000 | 40 | 13 | 20 | 39 | 73 | 11.0 |
| P5 | 13 | 2000 | 40 | 15 | 20 | 38 | 72 | 11.0 |

The following table illustrates the response data from the initial startup trials:

TABLE 9

| Initial Test Response Results | | | | | |
|---|---|---|---|---|---|
| | Fiber Diameter | | | | |
| Eff % | Mean | Min | Max | Range | % >500 nm |
| 49.476 | 430.38 | 149.84 | 932.62 | | 22.2 |
| 31.310 | 435.07 | 173.08 | 997.34 | | 22.8 |
| 27.600 | 468.87 | 185.90 | 809.18 | | 24.9 |
| 30.440 | 460.79 | 154.03 | 912.01 | | 29.0 |
| 29.130 | 446.05 | 187.84 | 997.27 | | 20.6 |

The initial startup trial results demonstrated fiber diameters less than 1 micron which met the primary initial startup goal. On the average 75% of the fibers were less than 500 nm in diameter. The minimum, maximum, and range of the fiber diameter are tracked as an alternate response to assist with result observations.

$2_{IV}^{8-3}$ $2_{IV}^{8-3}$

The Feedforward Backpropagation and the Radial Basis neural network models were the selected.

During the RSM Design of Experiments, arbitrary data trials were collected for the neural network analysis. The neural network trials for this data were not random, but the independent variables were arbitrarily chosen with different independent variable values. A total of 47 neural network data trials were collected with this approach.

Because of the production time and cost of performing trials, it was necessary to determine a strategic approach to collecting additional neural network data. This strategic approach would provide a viable array of data trials for the neural network analysis and also limit the number a data trials required. A second neural network data set was collected using this strategic approach. Seven intervals of the percent solids independent variable were selected based on the viable variable range selected for this research. This range of the percent solids variables was from 9.0% to 12.0%. At each percent solids value, seven random data trials were determined based on the boundary limits establish earlier in the research. A random function in Microsoft Excel was used determine the independent variables. Table 10 (below) shows the independent variable ranges and increments selected for the randomized strategic approach. A total of 49 data trials were performed using this approach.

TABLE 10

| ANN Feasibility Range | | | | | | | | |
|---|---|---|---|---|---|---|---|---|
| | ANN Feasible Variable Range | | | | | | | |
| | % Solids % | Motor Speed RPM | Voltage KV | Pump Rate ml/min | Field Gap Cm | Humidity % | Temp F. | Air flow SCFM |
| Delta | 0.25 | 250 | 1.0 | 1.0 | 1 | 1.0 | 1.0 | 0.1 |
| Min (0) | 9.00 | 3250 | 55.0 | 11.0 | 13.50 | 37.0 | 69.0 | 10.0 |
| (1) | 9.50 | | | | | | | |
| (2) | 10.00 | | | | | | | |
| (3) | 10.50 | | | | | | | |
| (4) | 11.00 | | | | | | | |
| (5) | 11.50 | | | | | | | |
| Max (6) | 12.00 | 4750 | 70.0 | 23.0 | 22.50 | 43.0 | 75.0 | 11.2 |

The data collected from both the arbitrary data set and the randomized data set were merged together to create one data set. A total of 96 trials were used for the neural network modeling evaluation.

Prior to importing the neural network data into the MATLAB software the trials were put into a randomized order.

The routines used to model the data were automatically normalized and configured. The input and output data were separated into two different matrices. Each matrix was imported separately into the neural network software. The data was randomly separated into three groups within the neural network software. Eighty percent of the data was used for training the network, ten percent of the data was used for testing the network, and ten percent of the data was used for validating the network.

The Levenberg-Marquardt training algorithm was selected to be used in the standard feedforward backpropagation. The weights and bias were not altered. A number of training routines were performed by altering the number of hidden layers to determine which level would provide the best performance. Also, retraining was performed 3 times at each hidden layer level to see if the squared correlation coefficient would improve. Table 11 (below) shows the R-values for each of the analysis.

TABLE 11

| Feedforward R values | | | |
|---|---|---|---|
| # of Hidden Layers | Trial 1 R^2 | Trial 2 R^2 | Trial 3 R^2 |
| 20 | 0.352 | 0.974 | 0.901 |
| 30 | 0.981 | 0.224 | 0.956 |
| 40 | 0.486 | 0.496 | 0.995 |
| 50 | 0.998 | 0.519 | 0.955 |
| 60 | 0.999 | 0.818 | 0.999 |
| 70 | 0.656 | 0.675 | 0.835 |

The best setting for the number of hidden layers was determined to be 60. FIG. 14 shows the fitting neural network.

For a proper fitted Performance Plot, the training, testing, and validation performance will parallel as they converge to the point where the gradient changes sign. FIG. 15 shows the performance plot result.

It is also important for the squared correlation coefficient R-Square ($R^2$) to be greater than 90% to demonstrate a good fit. FIG. 16 shows the results of residual plots. The R-values for the training and validation are above 0.90. The R-values for the model test are low. This means the random data selected for testing did not fit the trained model very well. The overall R-value indicated an average model fit. There are a few data points that do not follow very well. These data points may be from some poor test results. The squared correlation coefficient R-Square ($R^2$) for this trained network is 0.9957 which is considered to be a good accurate network fit.

The Radial Basis function neural network (RBF) is similar to other neural net algorithms. FIG. 17 shows an illustration of the Radial Basis Network Diagram. The same data set for the feedforward backpropagation neural network was also used for the Radial Basis neural network. The number of hidden layers was two. FIG. 18 shows the Radial Basis neural network design. The Radial Basis neural network training was conducted using the Neural Network Toolbox with MATLAB software. Several training iterations were conducted to ensure the performance results were consistent. FIG. 19 shows the residual plot results for the trained Radial Basis network. The Error Histogram Plot for this neural network shown in FIG. 20 indicates a good performance fit (e.g., as the Error Histogram plot shows that there is a good distribution around zero).

A second order objective function representing the RSM model described above is represented as follows:

$$y_0 y_1 y_2 y_3 y_4 y_5 x_1 9 \le x_1 \le 13 x_2 1{,}000 \le x_2 \le 5{,}000 x_3 40 \le x_3 \le$$

$$80 x_4 10 \le x_4 \le 25 x_5 12 \le x_5 \le 30 x_6 35 \le x_6 \le 45 x_7 70 \le x_7 \le$$

$$80 x_8 3 \le x_8 \le 11.2 \gamma x \gamma = \beta_0 + \beta_1 x_1 + \beta_2 x_2 + \ldots + \beta_k x_k + \varepsilon \varepsilon \gamma =$$

$$\beta_0 + \beta_1 x_1 + \beta_2 x_2 + \beta_{12} x_1 x_2 \ \ldots + \beta_k x_k + \beta_k x_k x_{k+1} + \varepsilon \gamma =$$

$$\beta_0 + \sum_{i=0}^{K} \beta_i x_i + \sum_{i=0}^{K} \beta_{ii} x_i^2 + \sum_{i>j} \beta_{ij} x_i x_j + \epsilon 2^k$$

One may use such objective function to predict results based on the inputs $x_1$ (percent solids), $x_2$ (motor speed in RPM), $x_3$ (voltage), $x_4$ (pump rate), $x_5$ (field gap), $x_6$ (humidity), x7(temperature.), and $x_8$ (airflow).

The complete disclosures of the patents, patent documents, and publications cited herein are incorporated by reference in their entirety as if each were individually incorporated. While the disclosure is susceptible to various modifications and alternative forms, specifics thereof have been shown by way of example and drawings, and will be described in detail. It should be understood, however, that the disclosure is not limited to the particular embodiments described. On the contrary, the intention is to cover modifications, equivalents, and alternatives falling within the spirit and scope of the disclosure.

The invention claimed is:

1. A fiber-forming process comprising:

providing a centrifugal electrospinning apparatus comprising:

an emitter comprising:

(a) a free-surface edge rotating at a rotational speed of between 1,000 and 4,000 rpm (b) a discharge portion having a forward surface defining a concave shape including a perpendicular ring region; and (c) a diffuser portion configured to mate with the discharge portion;

providing a collector;

providing a spinning solution comprising at least one polymer dissolved in at least one solvent;

supplying the spinning solution to the emitter; and directing the spinning solution from the emitter toward the collector under conditions effective to form separate fibrous streams from the spinning solution, vaporize the solvent, and produce polymeric fibers on the collector.

2. The process of claim 1 further comprising providing a voltage potential of 40-80 kV between the emitter and the collector.

3. The process of claim 1 wherein the rotating element of the emitter has a rotational speed of 3500 rpm or less.

4. The process of claim 3 wherein the rotating element of the emitter has a rotational speed of 3000 rpm or less.

5. The process of claim 1 wherein the rotating element of the emitter has a rotational speed of at least 1000 rpm.

6. The process of claim 1 wherein the rotating element defines a forward surface facing the collector configured to discharge the spinning solution centrally therefrom.

7. The process of claim 6 wherein:

the forward surface is a concave forward surface and defines a forward surface discharge edge; and the step of issuing the spinning solution from the emitter comprises issuing the spinning solution centrally and along the concave forward surface so as to distribute said spinning solution toward the forward surface discharge edge.

8. The process of claim 1 wherein the directing step comprises directing the spinning solution from the emitter toward the collector in a direction against gravity.

9. The process of claim 1 wherein the spinning solution has a viscosity of up to 1000 centipoise.

10. The process of claim 9 wherein the spinning solution has a viscosity of up to 100 centipoise.

11. The process of claim 1 wherein supplying the spinning solution to the emitter occurs at a throughput rate of 10-100 ml/min.

12. The process of claim 1 wherein the emitter and the collector are positioned to have a distance between them of 12-30 cm.

13. The process of claim 1 wherein air is supplied to the emitter at a rate of 3-12 scfm.

14. The process of claim 1 wherein the polymer is selected from the group of polyalkylene oxides, poly(meth)acrylates, polystyrene based polymers and copolymers, vinyl polymers and copolymers, fluoropolymers, polyesters and copolyesters, polyurethanes, polyalkylenes, polyamides, polyaramids, thermoplastic polymers, liquid crystal polymers, engineering polymers, biodegradable polymers, bio-based polymers, natural polymers, and protein polymers.

15. The process of claim 1 wherein the fibers have an average fiber diameter of up to 1,000 nm.

16. A fiber forming process comprising:

providing a centrifugal electrospinning apparatus comprising:

a rotating free surface edge emitter comprising:

a rotating element having a rotational speed of 10,000 rpm or less;

a discharge portion having a forward surface defining a concave shape including a perpendicular ring region;

a diffuser portion configured to mate with the discharge portion;

a controller; and a voltage potential of 40-80 kV between the emitter and the collector;

providing a spinning solution having a viscosity of up to 1000 centipoise, the solution comprising at least one polymer dissolved in at least one solvent;

supplying the spinning solution to the emitter; and directing the spinning solution from the emitter toward the collector under conditions effective to form separate fibrous streams from the spinning solution, vaporize the solvent, and product polymeric fibers on the collector.

17. The process of claim 16 wherein the rotating element of the emitter has a rotational speed of 3500 rpm or less.

18. The process of claim 16 wherein the spinning solution has a viscosity of up to 1000 centipoise.

* * * * *